US008862014B2

(12) United States Patent
Imaizumi et al.

(10) Patent No.: US 8,862,014 B2
(45) Date of Patent: Oct. 14, 2014

(54) ELECTROPHOTOGRAPHIC COLOR IMAGE FORMING APPARATUS WITH MOVABLE MEMBER FOR SUPPORTING A CARTRIDGE

(71) Applicant: Canon Kabushiki Kaisha, Tokyo (JP)

(72) Inventors: Chikara Imaizumi, Numazu (JP); Takeo Kawanami, Mishima (JP); Tomio Noguchi, Suntoh-gun (JP); Hiromi Fujinaka, Suntoh-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/860,119

(22) Filed: Apr. 10, 2013

(65) Prior Publication Data

US 2013/0243479 A1 Sep. 19, 2013

Related U.S. Application Data

(62) Division of application No. 13/446,154, filed on Apr. 13, 2012, now Pat. No. 8,442,412, which is a division of application No. 13/013,182, filed on Jan. 25, 2011, now Pat. No. 8,175,487, which is a division of application No. 12/570,328, filed on Sep. 30, 2009, now Pat. No. 7,907,866, which is a division of application No. 11/621,751, filed on Jan. 10, 2007, now Pat. No. 7,761,024.

(30) Foreign Application Priority Data

Jan. 11, 2006 (JP) ..... 2006-004022
Dec. 18, 2006 (JP) ..... 2006-340005

(51) Int. Cl.
*G03G 15/00* (2006.01)

(52) U.S. Cl.
USPC ..... 399/90; 399/112

(58) Field of Classification Search
USPC ..... 399/88, 89, 90, 111, 112
See application file for complete search history.

(56) References Cited

U.S. PATENT DOCUMENTS

| | | | |
|---|---|---|---|
| 6,101,349 | A | 8/2000 | Ohashi et al. |
| 6,708,011 | B2 | 3/2004 | Nomura et al. |
| 6,944,415 | B2 | 9/2005 | Nomura |
| 7,072,602 | B2 | 7/2006 | Hatori et al. |
| 7,092,657 | B2 | 8/2006 | Nakashima et al. |
| 7,426,355 | B2 | 9/2008 | Okabe |
| 7,486,907 | B2 | 2/2009 | Noguchi et al. |
| 7,509,071 | B2 | 3/2009 | Yoshimura et al. |
| 7,522,858 | B2 | 4/2009 | Okabe et al. |
| 7,565,096 | B2 | 7/2009 | Murayama |
| 7,567,769 | B2 | 7/2009 | Noguchi et al. |
| 2007/0071482 | A1 | 3/2007 | Okabe |
| 2007/0160380 | A1 | 7/2007 | Imaizumi et al. |
| 2007/0160384 | A1 | 7/2007 | Sakurai et al. |
| 2007/0160385 | A1 | 7/2007 | Noguchi et al. |
| 2007/0286632 | A1 | 12/2007 | Okabe |
| 2008/0159772 | A1 | 7/2008 | Koishi et al. |
| 2008/0159773 | A1 | 7/2008 | Murayama et al. |
| 2008/0159774 | A1 | 7/2008 | Tanabe et al. |
| 2008/0279579 | A1 | 11/2008 | Kuruma |

*Primary Examiner* — Robert Beatty
(74) *Attorney, Agent, or Firm* — Fitzpatrick, Cella, Harper & Scinto

(57) ABSTRACT

A color electrophotographic image forming apparatus includes a movable member for supporting and moving a cartridge. The movable member is movable between (i) a first position in which an electrophotographic photosensitive member carried on the movable member is contacted to a belt member and a latent image can be formed on the electrophotographic photosensitive member and (ii) a second position in which the electrophotographic photosensitive member is spaced from the belt member inside a main assembly frame. The movable member is also movable between the second position and a third position in which the cartridge is mountable and demountable relative to the movable member outside of the main assembly frame.

23 Claims, 17 Drawing Sheets

ELECTROPHOTOGRAPHIC COLOR IMAGE FORMING APPARATUS WITH MOVABLE MEMBER FOR SUPPORTING A CARTRIDGE

This application is a divisional of co-pending Ser. No. 13/446,154, filed Apr. 13, 2012, which is a divisional of U.S. patent application Ser. No. 13/013,182, filed Jan. 25, 2011, now U.S. Pat. No. 8,175,487, which is a divisional of U.S. patent application Ser. No. 12/570,328, filed Sep. 30, 2009, now U.S. Pat. No. 7,907,866, which is a divisional of U.S. patent application Ser. No. 11/621,751, filed Jan. 10, 2007, now U.S. Pat. No. 7,761,024.

FIELD OF THE INVENTION AND RELATED ART

The present invention relates to an electrophotographic color image forming apparatus which employs a process cartridge (or cartridges) removably mountable in the main assembly thereof.

As examples of an electrophotographic color image forming apparatus, there are an electrophotographic color image forming apparatus, an electrophotographic color printer (color laser printer, color LED printer, etc.), etc.

A process cartridge means a cartridge in which an electrophotographic photosensitive member, and one or more process means for processing the electrophotographic photosensitive member, are integrally disposed so that they can be removably mountable in the main assembly of the image forming apparatus. More specifically, a process cartridge is a cartridge in which an electrophotographic photosensitive member, and at least one among the abovementioned processing members, such as a developing means, a charging means, and a cleaning means, are integrally disposed.

A process cartridge is removably mountable in the main assembly of an image forming apparatus by a user himself or herself. Therefore, a process cartridge makes it possible for a user to maintain an image forming apparatus without relying on service personnel.

There have been known various structural arrangements for establishing electrical connection between a process cartridge and the main assembly of an electrophotographic color image forming apparatus.

For example, an electrophotographic image forming apparatus is structured so that multiple process cartridges are vertically juxtaposed in the movable guide rotatable about its axis. The process cartridges are moved by the rotational movement of the movable guide between the preset cartridge positions in the apparatus main assembly, and the preset outward positions where they are mountable into, or removable from, the movable guide (apparatus main assembly). Further, the movable guide is provided with an intermediary electrical contact (s).

In this structural arrangement, the electrical connection between the electrical contact on the cartridge side and the electrical contact on the apparatus main assembly side is established through the intermediary electrical contact (U.S. Pat. No. 7,092,657).

This structural arrangement ensures that electrical connection is established between the electrical contact on the cartridge side and those on the apparatus main assembly side.

In recent years, in the field of an electrophotographic color image forming apparatus, it has been thought of structuring an image forming apparatus so that multiple process cartridges are supported in the apparatus main assembly by being placed side by side in a movable member which is linearly movably relative to the apparatus main assembly.

This structural arrangement is smaller in the amount of space required for the movement of the movable member than the structural arrangement in which the movable member is rotationally moved.

SUMMARY OF THE INVENTION

Thus, the primary object of the present invention is to provide an electrophotographic color image forming apparatus in which the multiple process cartridges it employs are supported by being placed side by side in a movable member linearly movable relative to the apparatus main assembly, and which is characterized in that it is ensured that electrical connection is made between the electrical contact(s) on the process cartridge side and the electrical contact(s) on the main assembly side.

Another object of the present invention is to provide an electrophotographic color image forming apparatus structured so that the electrical contact(s) on the process cartridge side smoothly contacts the electrical contact(s) on the apparatus main assembly side.

According to an aspect of the present invention, there is provided a color electrophotographic image forming apparatus usable with process cartridges detachably mountable to a main assembly of said apparatus, said process cartridges each including an electrophotographic photosensitive drum and process means actable on said electrophotographic photosensitive drum, said color electrophotographic image forming apparatus comprising a movable member which is movable between an inside of the main assembly of the apparatus and an outside of the main assembly of the apparatus in a direction crossing with a longitudinal direction of said electrophotographic photosensitive drum while carrying said process cartridges; a main assembly electrical contact provided inside said main assembly of the apparatus along a movement path of said movable member; and an intermediary electrical contact including a first electrical contact portion which is disposed inside said movable member and which is electrically connectable to a cartridge electrical contact of said process cartridge and a second electrical contact portion which is disposed outside said movable member and which is electrically connectable to a main assembly electrical contact provided in said main assembly of said apparatus, wherein a space is provided between said movable member and said main assembly electrical contact to prevent said movable member from contacting to said main assembly electrical contact when said movable member moves from the outside to the inside, and wherein said second electrical contact portion is electrically connected to the main assembly electrical contact when said movable member lowers after said movable member moves linearly from the outside to the inside.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Embodiment 1

General Structure of Image Forming Apparatus

Figure 1:
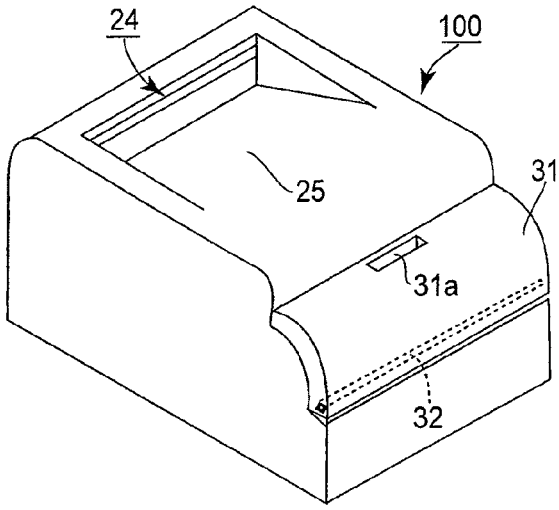
FIG. 1 is an external perspective view of the image forming apparatus in the first embodiment of the present invention.
Figure 2:
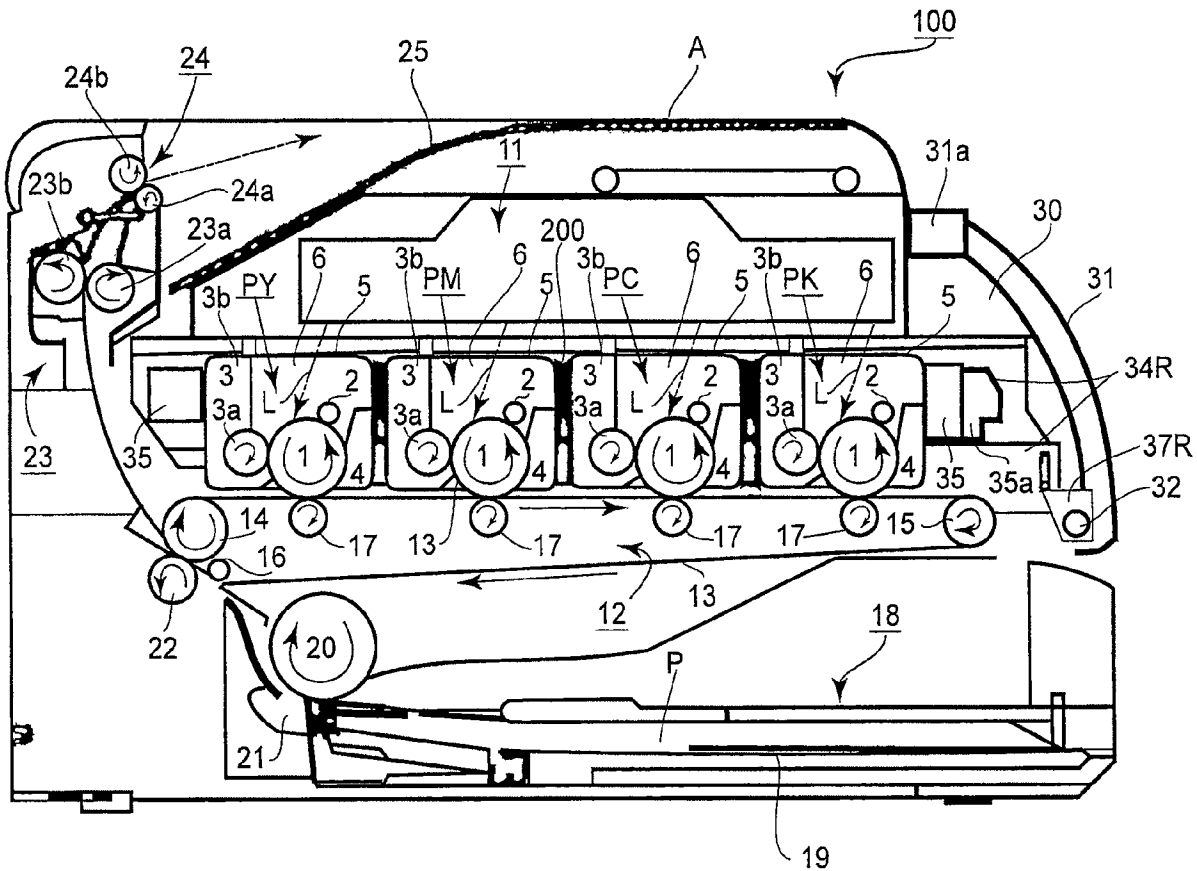
FIG. 2 is a vertical sectional view of the image forming apparatus shown in FIG. 1, as seen from the left side of the apparatus.

FIG. 1 is an external perspective view of the image forming apparatus 100 in this embodiment, and FIG. 2 is a vertical sectional view of the image forming apparatus 100, as seen from the left side of the apparatus. This image forming apparatus is a full-color laser printer based on four primary colors. It uses an electrophotographic process. It forms an image on recording medium (for example, recording paper, OHP sheet, label, etc.) in response to electrice picture signals inputted from an external host apparatus (unshown) such as a personal computer, an image reader, a sending facsimile machine, etc.

In the following description of the preferred embodiment of the present invention, the front side (front surface side) of the image forming apparatus means the side which has a door 31. The rear side of the image forming apparatus is the side opposite to the front side. "Frontward" means "in a direction toward front as seen from the rear side of the apparatus main assembly", and "rearward" means the direction opposite to "frontward". "The left and right sides of the apparatus main assembly" means the left and right sides of the apparatus main assembly as seen from the front side of the apparatus main assembly. "Leftward" means "in a direction toward left as seen from the front side", and "rightward" means the direction opposite to "leftward".

There are four process cartridges (first to fourth), that is, PY, PM, PC, and PK, in the apparatus main assembly (main frame 80). The four cartridges PY, PM, PC, and PK are horizontally arranged in the listed order in terms of the rear-to-front direction (which may be referred to as inline, or tandem arrangement). The four cartridges are the same in structure, although they are different in the color of the toners they store. Each cartridge in this embodiment is made up of: an electrophotographic photosensitive drum 1; processing means, that is, a charging means 2, a developing means 3, and a cleaning device 4, which process the photosensitive drum 1; and a cartridge frame 5 (FIGS. 7 and 8), in which the preceding components are integrally disposed. The charging device 2 in this embodiment is a charge roller. The developing device 3 in this embodiment uses a development roller 3*a*. In a developer container, developer (toner) is stored. As the cleaning means, a cleaning blade is used.

The developer container 3*b* of the first cartridge PY stores yellow (Y) toner. On the peripheral surface of the drum 1 in the cartridge PY, a toner image of yellow (Y) color is formed. The developer container 3*b* of the second cartridge PM stores magenta (M) toner. On the peripheral surface of the drum 1 in the cartridge PM, a toner image of magenta (M) color is formed. The developer container 3*b* of the third cartridge PC stores cyan (C) toner. On the peripheral surface of the drum 1 in the cartridge PC, a toner image of cyan (C) color is formed. The developer container 3*b* of the fourth cartridge PK stores black (K) toner. On the peripheral surface of the drum 1 in the cartridge PK, a toner image of black (K) color is formed.

In the area above the cartridges PY, PM, PC, and PK, a laser scanner unit 11 is disposed. This scanner unit 11 outputs a beam of laser light L while modulating it with picture information regarding the monochromatic image to be formed by each cartridge. The beam of laser light L transmits through the exposure window 6 (FIGS. 7 and 8) with which the top wall of the cartridge frame 5 is provided, and exposes the peripheral surface of the drum in each cartridge.

In the area below the cartridge PY, PM, PC, and PK, an intermediary transfer belt unit 12 is disposed, which has an endless belt 13, a driver roller 14, a turn roller 15, and tension roller 16. The endless belt 13 is flexible. It is stretched around the driver roller 14, turn roller 15, and tension roller 16, being thereby suspended by them, so that it can be circularly driven. The driver roller 14 and tension roller 16 are disposed in the rear portion of the apparatus main assembly A, whereas the turn roller 15 is disposed in the front portion of the apparatus main assembly A. Each cartridge is disposed so that the downwardly facing portion of the peripheral surface of the drum 1 of each cartridge remains in contact with the upwardly facing portion of the external surface of the endless belt 13. On the inward side of the loop which the belt 13 forms, four primary transfer rollers 17 are disposed. Each transfer roller 17 is disposed so that it opposes the drum 1 in the corresponding cartridge, with the portion of the endless belt 3, which corresponds to the top portion of the loop, pinched between the transfer roller 17 and photosensitive drum 1. The driver roller 14 is kept pressed against a secondary transfer roller 22, with the belt 13 pinched between the two rollers 14 and 22.

In the area below the belt unit 12, a paper feeder unit 18 is disposed, which has a tray 19, a feeder roller 20, a separation pad 21, etc. The tray 19 is removably mountable in the apparatus main assembly from the front side (front loading).

In the top portion of the rear portion of the apparatus main assembly A, a fixing apparatus 23 and a paper discharging roller pair 24 are disposed. Further, the top wall of the frame (housing) constitutes a delivery tray 25. The fixing apparatus 23 has a fixation film assembly 23*a* and a pressure application roller 23*b*. The paper discharging roller pair 24 has a paper discharging rollers 24*a* and 24*b*.

When each cartridge is in its preset position in the apparatus main assembly, it is securely held in the preset position by the pressure applied by a pressing member, which will be described later. Further, the driving force input portion of the cartridge is in engagement with the driving force output portion of the apparatus main assembly, and the electrical contacts of the cartridge are in connection with the corresponding electrical contacts of the apparatus main assembly, making it possible to provide the cartridge with the electric power from the power supply system on the apparatus main assembly side.

The operation carried out by this image forming apparatus to form a full-color image is as follow: Each of the first to fourth cartridges PY, PM, PC, and PK is rotationally driven at a preset (controlled) velocity in the counterclockwise direction indicated by an arrow mark. Further, the belt 13 is circularly driven in the clockwise direction indicated by an arrow mark (subordinate direction to rotational direction of photosensitive drum) at a velocity which corresponds to the peripheral velocity of the photosensitive drum 1. The scanner unit 11 is also driven. In synchronization with the driving of the scanner 11, the charge roller 2 in each cartridge uniformly charges the peripheral surface of the photosensitive drum 1 to preset polarity and potential, with a preset (controlled) timing. The scanner unit 11 scans (exposes) the peripheral surface of each photosensitive drum 1 with the beam of laser light L while modulating the beam of laser light L with the picture signals for forming an monochromatic image of the primary color assigned to each cartridge. As a result, an electrostatic latent image, which reflects the picture signals corresponding to the primary color assigned to the cartridge, is effected on the peripheral surface of the photosensitive drum 1. This electrostatic latent image is developed by the development roller 3*a* into a visible image, that is, an image formed of developer (which hereafter will be referred to as developer image).

Through the above described electrophotographic image formation process, a yellow toner image, which corresponds to the yellow color component of an intended full-color image is formed on the drum 1 of the first cartridge PY. This yellow toner image is transferred (primary transfer) onto the belt 13.

On the drum 1 of the second cartridge PM, a magenta developer image, which corresponds to the magenta color component of the full-color image is formed, and this toner image is transferred (primary transfer) onto the belt 13 so that it is layered on the yellow toner image which is already on the belt 13.

On the drum 1 of the second cartridge PC, a cyan developer image, which corresponds to the cyan color component of the full-color image is formed, and this developer image is transferred (primary transfer) onto the belt 13 so that it is layered on the yellow and magenta developer images which are already on the belt 13.

On the drum 1 of the second cartridge PK, a black developer image, which corresponds to the black color component of the full-color image is formed, and this developer image is transferred (primary transfer) onto the belt 13 so that it is layered on the yellow, magenta, and cyan developer images which are already on the belt 13.

Consequently, an unfixed full-color developer image is synthetically effected on the belt 13 by the four monochromatic color developer images, that is, the yellow, magenta, cyan, and black color developer images.

After the primary transfer of the developer image onto the belt 13, the developer remaining on the peripheral surface of the drum 1 in each cartridge is removed by the cleaning means 4.

Meanwhile, the feeder roller 20 is driven with the preset (controlled) timing. As the feeder roller 20 is driven, the topmost sheet of recording paper P, as a recording medium, of the stack of sheets of recording paper P on the tray 19 is separated from the rest of the sheets of recording medium by the coordination of the feeder roller 20 and a separation pad 21, and is fed into the apparatus main assembly by the feeder roller 20. The recording paper P is introduced into the nip (secondary transfer nip), that is, the interface between the secondary transfer roller 22 and belt 13, and then, is conveyed through the nip while remaining pinched by the secondary transfer roller 22 and belt 13. While the recording paper P is conveyed through the nip, the four layers of developer images different in color are transferred together onto the recording paper P as if they were peeled away from the belt 13, starting from their leading edges.

The recording paper P is separated from the surface of the belt 13, and is introduced into the fixing apparatus 23, and is subjected to heat and pressure in the fixation nip of the fixing apparatus 23. As a result, the four layers of developer images different in color are fixed to the recording paper P. Thereafter, the recording paper P is moved out of the fixing apparatus, and then, is discharged as a full-color copy onto the tray 25 by the discharge roller pair 24.

In this embodiment, after the separation of the recording paper P from the belt 13, the developer remaining on the surface of the belt 13 is electrostatically adhered to the peripheral surface of the drum 1 of the first process cartridge PY, for example, in the primary transfer area between the first process cartridge and photosensitive drum 1, and then is removed by the cleaning means 4 of the first process cartridge PY.

(Method for Replacing Cartridge)

As an image forming operation is carried out by each of the first to fourth cartridges PY, PM, PC, and PK, the developer (toner) stored in the developing device 3 of each cartridge is consumed.

Thus, the image forming apparatus is provided with a means (unshown) for detecting the amount of the developer remaining in each cartridge. The detected amount of the developer in each cartridge is compared, by the control portion of the image forming apparatus, with a threshold value preset for issuing a warning, such as the cartridge is near the end of its service life, or the cartridge has reached the end of its service life. If the detected amount of the residual developer in the cartridge is smaller than the preset threshold value, the message which warms the user that the cartridge is close to the end of its life or has reached the end of its life is displayed on the screen of the monitor; in other words, the image forming apparatus prompts the user to prepare a replacement cartridge, or to replace the cartridge, in order to maintain a preset level of image quality.

In order to improve the image forming apparatus in usability, the image forming apparatus in this embodiment is provided with a cartridge drawer (tray) which can be pulled out frontward to make it easier for a user to access the cartridges from the front side of the apparatus, in order to replace the cartridge.

When the cartridge tray is in its outermost position relative to the apparatus main assembly A, all the cartridges held by the cartridge tray are outside the apparatus main assembly A, making it easier for the cartridges in the tray to be replaced.

More specifically, the front wall of the image forming apparatus is provided with an opening 30 (FIG. 2), through which the cartridge can be inserted into, or removed from, the apparatus main assembly.

Further, the apparatus main assembly is provided with a door 31, which can be rotationally moved between the closed position and open position.

Figure 3:
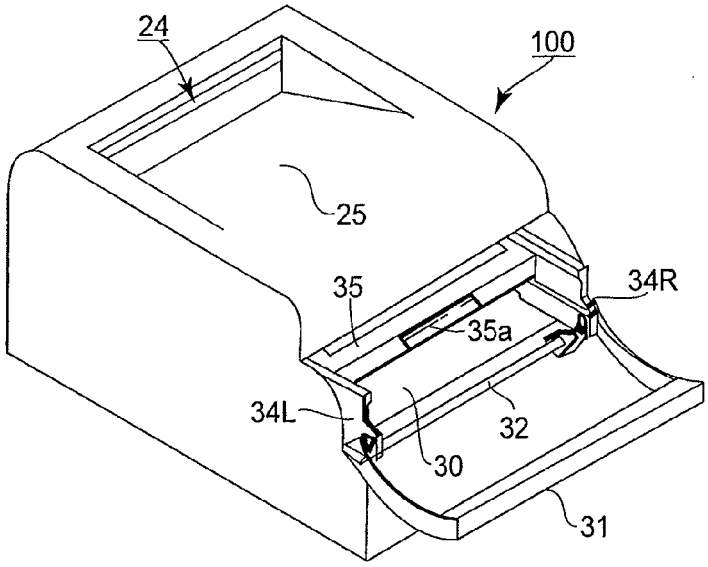
FIG. 3 is an external perspective view of the image forming apparatus, shown in FIG. 1, the font door of which is open.
Figure 4:
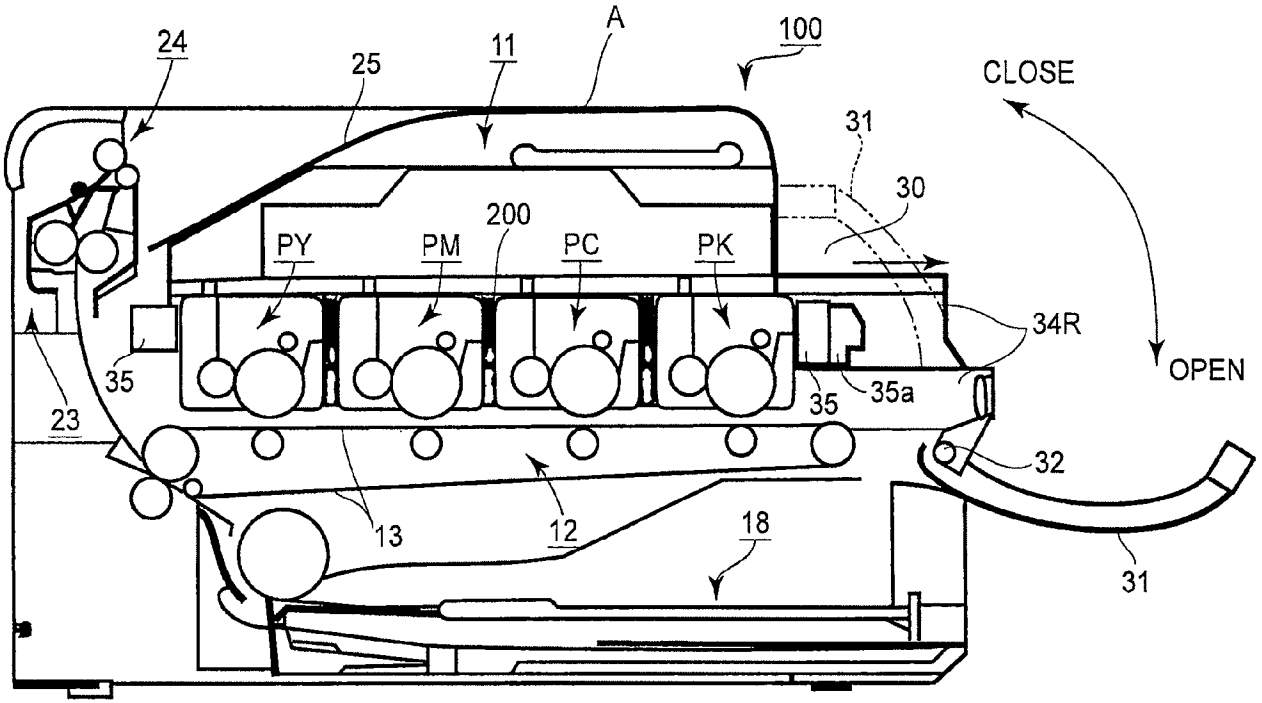
FIG. 4 is a vertical sectional view of the image forming apparatus, shown in FIG. 3, the front door of which is open, as seen from the left side of the apparatus main assembly.

In this embodiment, this door 31 is rotationally moved relative to the apparatus main assembly A about a horizontal shaft 32 (hinge shaft) located at the horizontal bottom edge of the door. That is, the door 31 is rotated about the hinge shaft 32 so that it can be moved into the closed position (roughly vertical position), in which it remains shut against the apparatus main frame A, covering the opening 30, as shown in FIGS. 1 and 2, and also, so that it can be rotated frontward about the hinge shaft 32 into the open position (roughly horizontal position), as shown in FIGS. 3 and 4, widely exposing the opening 30 of the front panel of the apparatus main frame. Designated by a referential character 31*a* is a recess for finger placement, with which the door 31 is provided to make it easier for an operator to open or close the door 31.

The left and right panels 81L (FIG. 17) and 81R which constitute the primary components of the apparatus main frame are provided with a pair of tray holding members 34L and 34R (moving means), respectively, which are on the inward side of the left and right panel 81L and 81R, and the lengthwise direction of which coincides with the fore-and-aft direction of the apparatus main assembly. The holding members 34L and 34R oppose each other. Between the holding members 34L and 34R, a cartridge tray (moving member) 35 is disposed. The holding members 34L and 34R holds the tray 35 so that the tray 35 can be horizontally slid in the fore-and-aft direction of the apparatus main assembly. The cartridges PY, PM, PC, and PK are held by this tray 35.

As the door 31 is opened, the holding members 34L and 34R are moved both frontward and upward of the apparatus main assembly by preset distances, by the movement of the door 31 transmitted to the holding members 34L and 34R through a mechanical linkage. This movement of the holding members 34L and 34R will be described later in more detail. As a result, the holding members 34L and 34R come out of the apparatus main assembly through the opening 30 so that the front end portion of each holding member 34 extends outward of the apparatus main assembly by a preset distance, as shown in FIGS. 3 and 4. The mechanical linkage which causes the movement of the door 31 to move the holding members 34L and 34R will be described later in more detail.

As the holding members 34L and 34R are moved, the driving force output portions on the apparatus main assembly side are disengaged from the corresponding driving force input portions of the cartridges PY, PM, PC, and PK, respectively (mechanical disengagement). Further, the pressure applied to each cartridge by the pressure application member to secure the cartridge is removed from the cartridge (pressure removal). Further, the electrical contacts of each cartridge are disengaged from the counterparts on the apparatus main assembly side, making it thereby impossible for electric power to be supplied to the cartridge from the power supplying system on the apparatus main assembly side (electrical disengagement). Moreover, the tray 35 is rendered freely movable.

Figure 5:
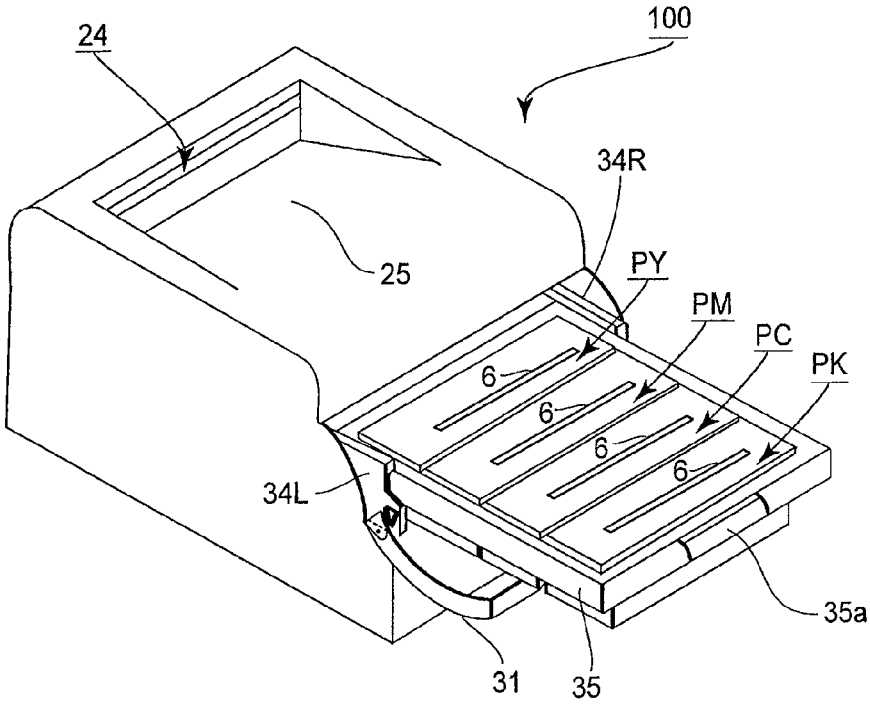
FIG. 5 is an external perspective view of the image forming apparatus, shown in FIG. 1, the cartridge tray of which is in its outermost position.
Figure 6:
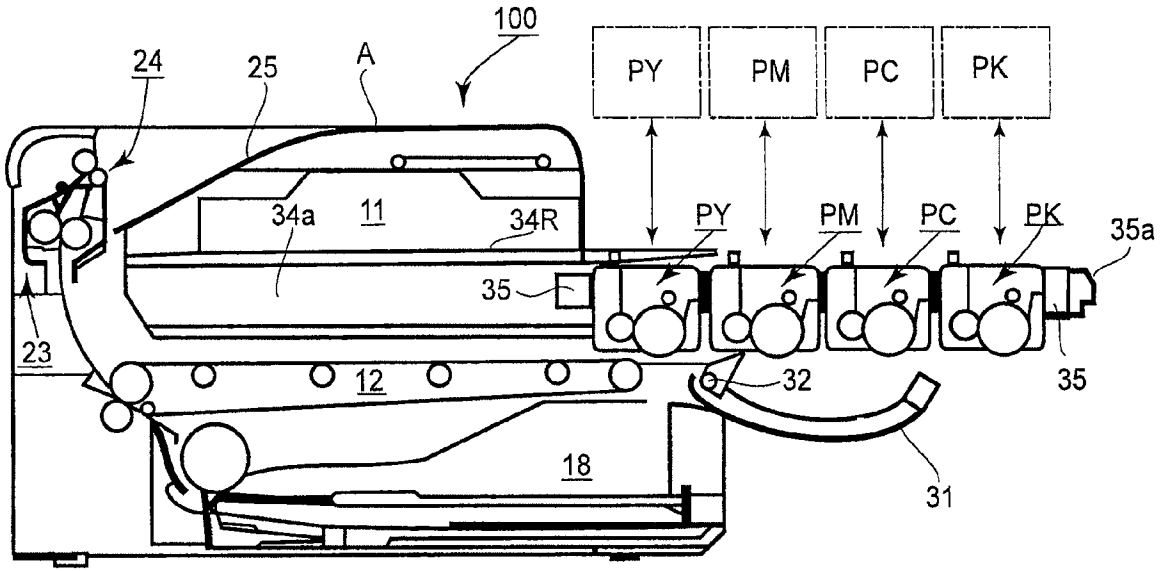
FIG. 6 is a vertical sectional view of the image forming apparatus, shown in FIG. 4, the cartridge tray of which is in its outermost position, as seen from the left side of the apparatus.

The handle 35*a* is exposed through the opening 30. An operator is to grasp the handle 35*a* and pull the tray 35 horizontally frontward to cause the tray 35 to slide on the holding members 34L and 34R until the tray 35 fully comes out through the opening 30 to a preset position, as shown in FIGS. 5 and 6.

As the tray 35 is pulled out to the abovementioned preset position, the first-fourth cartridges PY, PM, PC, and PK held in the tray 35 are all moved out of the apparatus main assembly move through the opening of the apparatus main assembly, being exposed from the apparatus main assembly A; the top surface of each cartridge is exposed. The apparatus main assembly is structured so that as the tray 35 is pulled out by a preset distance which is sufficient to expose all the cartridges, it is prevented by an unshown stopper portion from being pulled out further, and also, so that once the tray 35 is fully pulled out, it is securely retained in this outermost position by the holding members 34L and 34R.

The tray 35 is structured so that each cartridge held in the tray 35 can be moved out straight upward from the tray 35, and also, so that the replacement cartridge for each of the first to fourth cartridges can be mounted into the tray 35 from directly above. Thus, the cartridge or cartridges, which are to be replaced, that is, the cartridge or cartridges, the life of which has expired, can be extracted from the tray 35 by simply lifting it, as shown by a double-dot chain line in FIG. 6, and then, a bran-new cartridge or cartridges can be fitted, from directly above, into the vacated space or spaces, one for one, in the tray 35.

The tray 35 described above is a member that is movable in the direction intersectional to the axial direction of the drum 1 in each cartridge, and is movable between a preset position in the apparatus main assembly A, and a preset position outside the apparatus main assembly A. Further, the tray 35 is enabled to take the cartridge mounting or removing position, which is outside the apparatus main assembly A, a transitional position from which the cartridge 35 is moved into the latent image formation position, and the latent image formation position.

In this embodiment, the tray 35 holds the cartridges PK, PC, PM, and PY, in which the developers of K, C, M, and Y colors, respectively, are stored. The order in which the cartridges PK, PC, PM, and PY are arranged in the tray 35 is the same as they are listed above, in terms of the upstream to downstream direction, that is, the direction in which the tray 35 is moved inward of the apparatus main assembly A from the outward side of the apparatus main assembly A. In other words, in this embodiment, the cartridges are arranged according to developer consumption, with the cartridge highest in developer consumption, that is, the cartridge highest in replacement frequency, placed closest to the side from which a user operates the image forming apparatus. Therefore, the distance by which the tray 35 must be pulled out of the apparatus main assembly to expose the cartridge PK is very small. Thus, the image forming apparatus in this embodiment is superior to an image forming apparatus in accordance with the prior art, in terms of the efficiency with which the cartridge PK can be replaced.

The left and right holding members 34L and 34R constitute a means for controlling the movement of the tray 35. That is, they move upward the tray 35 from the latent image formation position before they move the tray 35 to the abovementioned outermost position. They also move downward the tray 35 into the abovementioned latent image formation position. In other words, the holding members 34L and 35R are enabled to take the first position, in which they allow the tray 35 to be moved between the abovementioned outermost position and transitional position, and the second position, in which they retain the tray 35 in the abovementioned latent image formation position. As the door 31 is closed, the holding members 34L and 34R are moved from the first position to the second position by the movement of the door 31.

Figure 7:
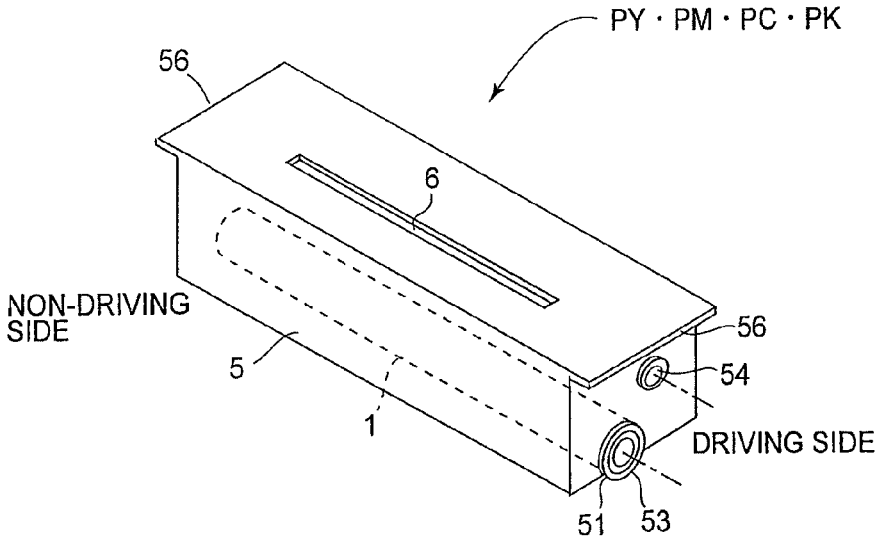
FIG. 7 is an external perspective view of the cartridge, as seen from the side from which the cartridge is driven.
Figure 8:
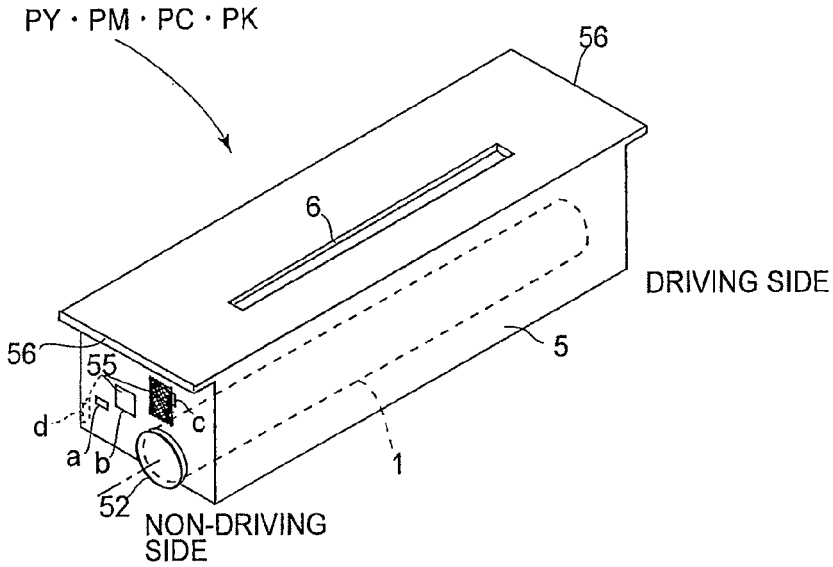
FIG. 8 is an external perspective view of the cartridge, as seen from the side from which the cartridge is not driven.

FIGS. 7 and 8 are external perspective views of one of the cartridges, as seen from the side from which the cartridge is driven, and the side from which the cartridge is not driven, respectively.

In this embodiment, when a cartridge is in the apparatus main assembly, the leftward or rightward direction of the cartridge is the direction parallel to the axial line of the drum 1. Each cartridge is an assembly of various components, and is roughly in the form of a rectangular parallelepiped, the lengthwise direction of which coincides with the abovementioned leftward or rightward direction. The drum 1 in each cartridge is disposed between the right and left walls of the frame 5 (housing) of the cartridge, being supported by a pair of bearing portions 51 and 52 with which the right and left walls are provided, respectively; in other words, the drum 1 is rotatably supported by the housing 5. The right bearing portion 51 is provided with a coupler 53 as a portion through which the drum driving force is inputted. Further, the right wall of the housing 5 is provided with a coupler 54 as a portion through which the force for driving development roller 3*a* is inputted. The left wall of the housing 5 is provided with electrical contacts 55 of the cartridge. More specifically, each cartridge is provided with four electrical contacts 55 (different in locations), which are for the charge roller 2, development roller 3*a*, developer supply member (unshown), and developer regulating member (unshown), one for one. Of the four electrical contacts on the cartridge side, the electrical contact designated by a referential letter a is connected to the development roller 3*a*, and receives the development bias supplied to the development roller 3*a* from the apparatus main assembly A. The electrical contact designated by a referential letter b is connected to the developer regulating member (unshown), and receives the developer regulating member bias supplied to the developer regulating member (unshown) from the apparatus main assembly A. The electrical contact designated by a referential letter c is connected to the charge roller 2, and receives the charge bias supplied to the charge roller 2 from the apparatus main assembly. The electrical contact designated by a referential letter d is connected to the developer supply member (unshown), and receives the developer supply member bias supplied to the developer supply member from the apparatus main assembly. The three electrical contacts a, b, and c are exposed at the end surface of one of the lengthwise ends of the photosensitive drum 1, whereas the electrical contact d is exposed at the leading end portion of the lateral surface, in terms of the direction in which the tray 35 is moved from outside the apparatus main apparatus into the apparatus main assembly. Of the cartridges described above, the right-hand side of the cartridge, that is, the side having the couplers 53 and 54, may be referred to as drivable side, and the left-hand side, that is, the opposite side from the right-hand side, may be referred to as non-drivable side.

Figure 9:
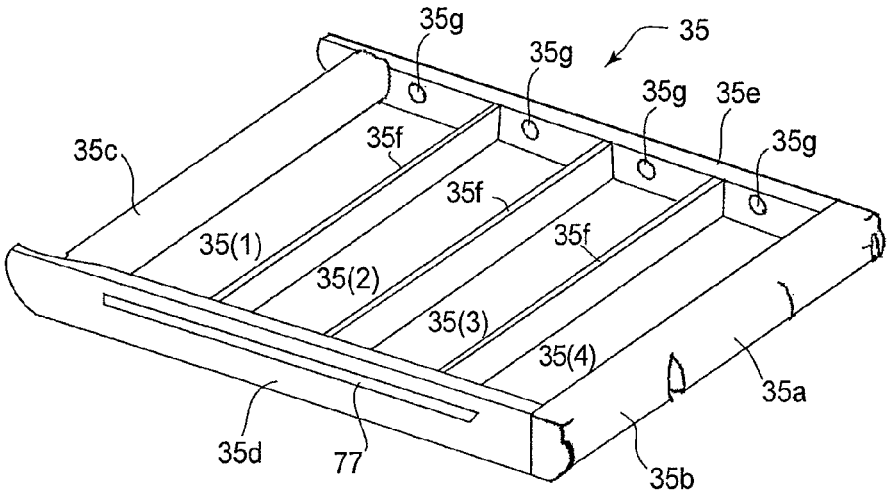
FIG. 9 is a perspective view of the cartridge tray.

FIG. 9 is an external perspective view of the tray 35. The tray 35 has a rectangular main frame, which is made up of four sections 35*b* (front), 35*c* (rear), 35*d* (left), and 35*e* (right), which are formed of a metallic substance and are joined at their lengthwise ends. The space within the rectangular main frame is partitioned into four sub-spaces of roughly the same size by three partition plates 35*f* which extend in the fore-and-aft direction, connecting the left and right sections of the main frame. Hereafter, these four sub-spaces will be referred to as first-fourth spaces 35(1)-35(4), listing from the rear section 35*c* side toward the front section 35*b*. These sub-spaces 35(1)-35(4) are the first cartridge placement spaces (cartridge placement compartments) in which the first to fourth cartridges PY, PM, PC, and PK are held, respectively. The portions of the rear section 35*e* of the main frame of the tray 35, which correspond to the sub-spaces 35(1)-35(4), are provided with a hole 35*g*, which is for allowing the development roller driving coupler 35*g* to move into, or out of, the corresponding sub-space. Incidentally, designated by a referential number 200 is a cartridge placement second space (cartridge placement compartment). Each cartridge held in the cartridge placement spaces 200 receives driving force from the apparatus main assembly A through the drum driving coupler 39 and development roller driving coupler 40.

Further, the tray 35 is provided with intermediary electrical contacts 72*a*-72*d* (FIG. 21), each of which makes contact with the electrical contact 55 (FIG. 8) of the corresponding cartridge. These intermediary electrical contacts 72*a*-72*d* are electrically connectible to the electrical contacts 75*a*-75*d* (FIGS. 21 and 22) with which the apparatus main assembly is provided. These electrical contacts and their connection will be described later. Incidentally, the electrical contacts 75*a*-75*d* on the main assembly side is indirectly connected to the electrical contacts 55*a*-55*d* on the cartridge side through the intermediary electrical contacts 72*a*-72*d*. The electrical contact 55*a* is for supplying development roller 3*a* with development bias, and the electrical contact 55*b* is for supplying the developer regulating member (unshown) with regulating member bias. Further, the electrical contact 55*c* is for supplying the charge roller 2 with charge bias, and the electrical contact 55*d* is for supplying the developer supply member (unshown) with supply member bias (FIGS. 8 and 21).

Each cartridge is to be inserted from directly above into one of the sub-spaces of the tray 35, which has been predesignated for the cartridge. As the cartridge is inserted, the left and right overhangs 56 are caught, by their bottom surfaces, by the top surfaces of the left and right sections 35*d* and 35*e* of the main frame of the tray 35; in other words, the cartridge is supported by the tray 35. That is, the tray 35 supports each cartridge so that the cartridge can be removed from the tray 35 in the vertically upward direction; in other words, as each cartridge is moved downward into the tray 35 from directly above the tray 35, the cartridge is supported by the tray 35. With the employment of the above described structural arrangement, the four cartridges PY, PM, PC, and PK are precisely positioned in the tray 35, without being fastened to the tray 35. Therefore, they can be easily replaced.

Figure 10:
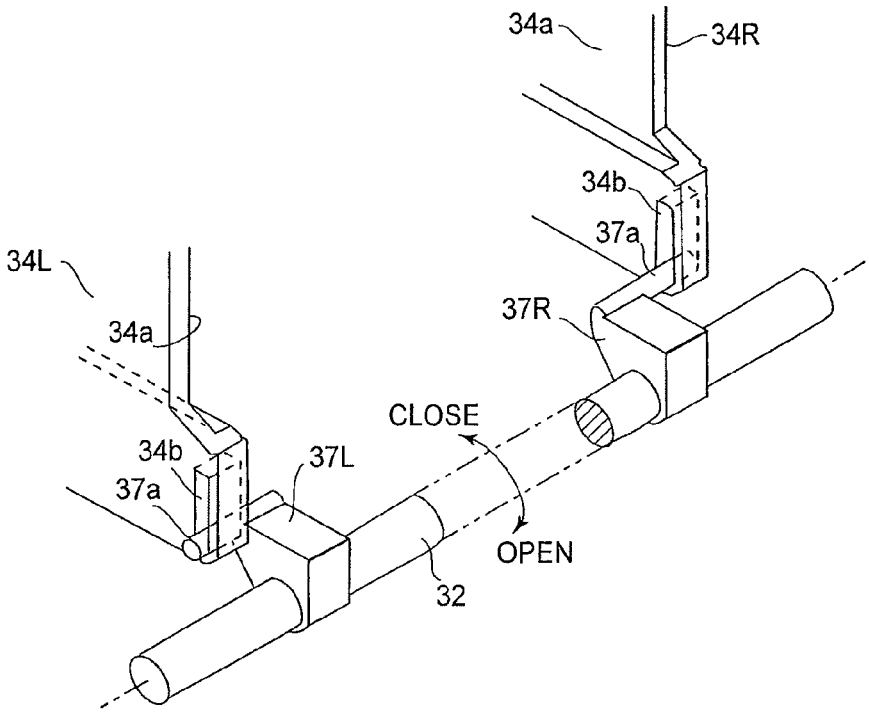
FIG. 10 is a perspective view of the mechanical linkage between the door and tray holding members.
Figure 21:
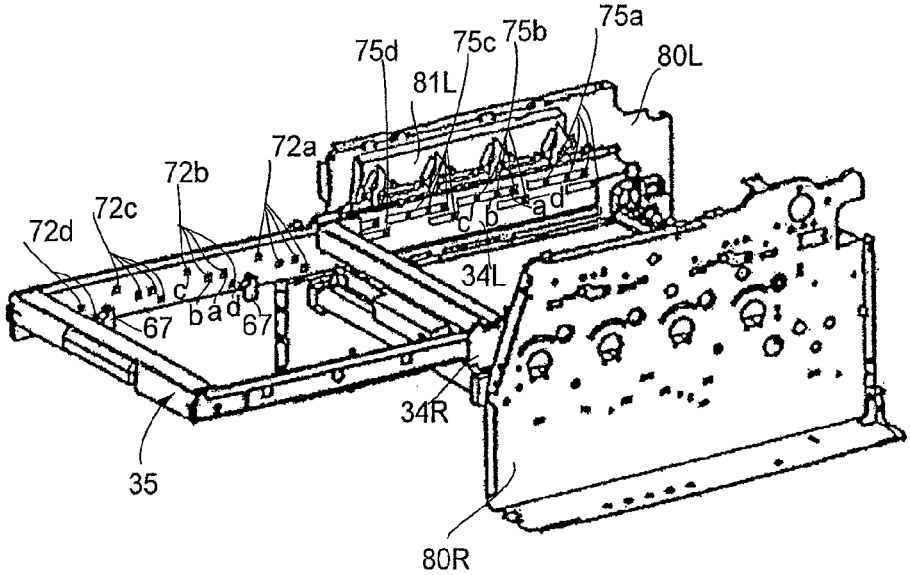
FIG. 21 is a drawing (1) showing the means for supplying electric power to a cartridge.

The inward surface of the left holding member 34L and the inward surface of the right holding member 34R are provided with a guiding groove 34*a* (FIGS. 6, 10, and 21). The left and right sections of the main frame of the tray 35 fit in these grooves 34*a*, one for one. Thus, not only is the tray 35 supported between the left and right holding members 34L and 34R, but also, it is allowed to slid in the fore-and-aft direction, with the left and right sections 35*d* and 35*e* of its main frame sliding in the guiding grooves 34*a* of the holding members 34L and 34R.

Referring to FIGS. 5 and 6, after the tray 35 is drawn out into its outermost position, and the cartridge, or cartridges, in the tray 35, which are to be replaced, are replaced, the tray 35 is to be pushed in the direction opposite to the direction in which it is pulled out of the apparatus main assembly; in other words, the tray 35 is to be pushed back into the apparatus main assembly (it is to be moved back into the transitional position). Then, the tray 35 is to be moved back into the latent image formation position). Then, the tray 35 is to be returned to the position, shown in FIGS. 3 and 4, in which the tray 35 was before it was pulled out. Thereafter, the user is to close the door 31 against the housing of the apparatus main assembly, as shown in FIGS. 1 and 2.

As the door 31 is closed, the holding members 34L and 34R are moved downwardly rearward, by the preset distance, by the rotational closing movement of the door 31. As a result, each cartridge is moved into its designated position in the apparatus main assembly. Further, the movement of the holding members 34L and 34R causes the cartridge pressing members to apply pressure to the corresponding cartridges to secure the cartridges in their preset positions. As a result, the downwardly facing area of the peripheral surface of the drum 1 in each cartridge comes into contact with the point (area) of the belt 13, which coincides with the specific point preset for each cartridge. In addition, each of the driving force outputting portions of the apparatus main assembly engages with the driving force input portion of the corresponding cartridge, establishing electrical connection between the power supply system of the apparatus main assembly and the electrical contact of each cartridge. That is, while each cartridge is moved downward by the downward movement of the tray 35, the abovementioned intermediary electrical contacts 72*a*-72*d* become electrically connected to the electrical contacts 75*a*-75*d* on the main assembly side, respectively, establishing thereby the electrical connection between the contacts 75*a*-75*d* on the main assembly side 75*a*-75*d* and the electrical contacts 55 on the cartridge side.

(Mechanical Linkage Between Door 31 and Holding Members 34L and 34R)

FIG. 10 is a perspective view of the mechanical linkage between the door 31 and holding members 34L and 34R. The hinge shaft 32 of the door 31 is horizontally disposed in parallel to the left and right direction of apparatus main assembly A. The hinge shaft 32 is rotatably supported at its lengthwise ends by, and between, the left and right frames 80L and 80R (FIG. 17) of the apparatus main assembly. The door 31 is solidly attached to the hinge shaft 32. Thus, as the door 31 is rotationally opened or closed, the hinge shaft 32 rotates with the door 31. The hinge shaft 32 is provided with a pair of connective arms 37L and 37R, which are attached to the portions of the hinge shaft 32, which are close to the left and right lengthwise ends of the hinge shaft 32. The arms 37L and 37R are solidly attached to the hinge shaft 32 so that they are the same in rotational phase. The arms 37L and 38R are provided with their own horizontal shaft 37*a*. The horizontal arm 37*a* of the left arm 37L is fitted in a hole 34*b* with which the bottom front portion of the left holding member 37L is provided, and the horizontal shaft 37*a* of the right arm 37R is fitted in a hole 34*b* with which the bottom front portion of the right holding member 34R is provided. Both holes 34*b* are elongated in cross-section.

In other words, the hinge shaft 32 is connected to the holding members 34L and 34R, with the interposition of the arms 37L and 37R, shafts 37*a*, and holes 34*b*. Thus, as the door 31 is opened or closed, the force applied to the door 31 to move the door 31 is transmitted to the left and right holding members 34L and 34R in a manner to move them in the fore-and-aft direction.

Each of the holding members 34L and 34R is provided with a pair of pins 34*c*, which protrude from the front and rear portions (with presence of preset distance) of the holding member. Further, each of the left and right frames 80L and 80R are provided with a pair of guiding slots 36. The pins 34*c* are fitted in these guiding slots 36, one for one, whereby the holding members 34L and 34R are supported by the left and right frames 80L and 80R, respectively.

Figure 11:
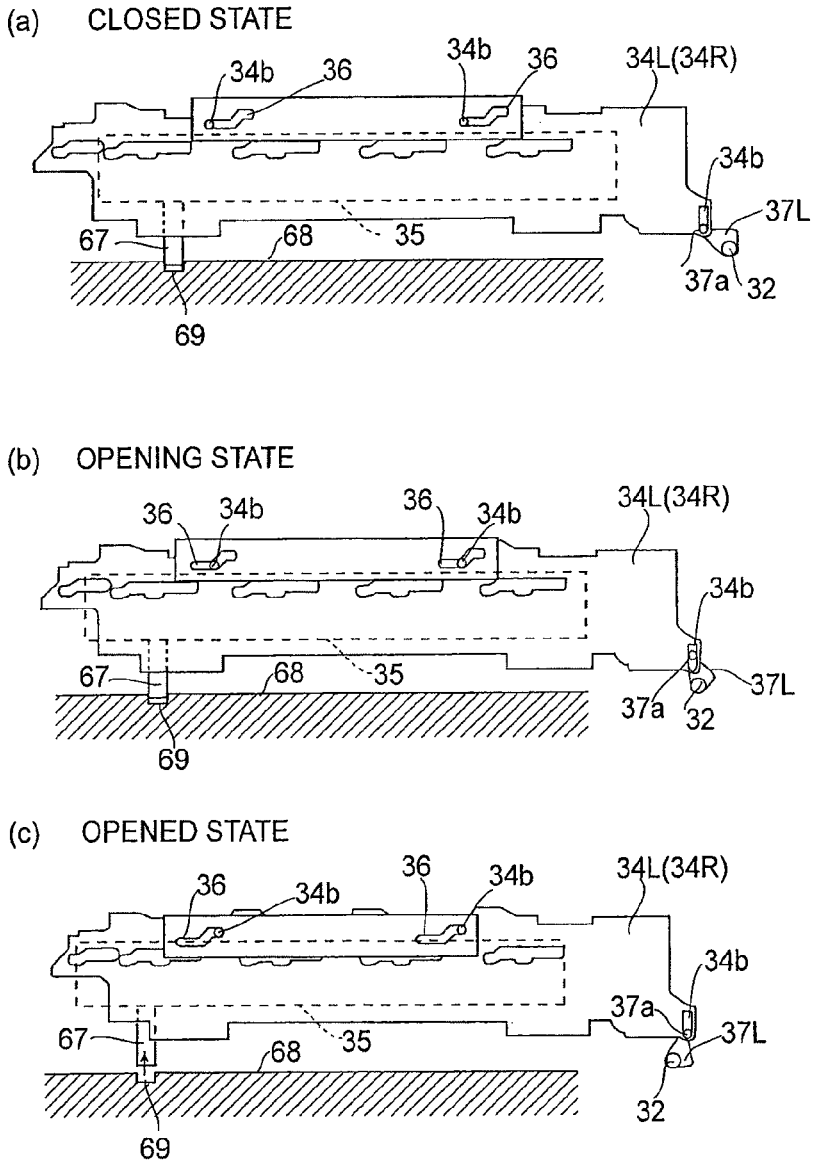
FIGS. 11(*a*) through 11(*c*) are schematic drawings showing the movement of the tray holding member, which is caused by the rotational door movement which occurs when the door is opened.

FIGS. 11(*a*) through 11(*c*) show the two pins 34*c* of the left holding member 34L, and the guiding slots 36 of the left frame 80L. It does not show the right holding member 34R. But, the right holding member 34R is the same as the left holding member 34L, except that its pins 34*c* and the corresponding guiding slots 36 of the left frame 80L are symmetrically positioned relative to those of the left holding members 34L and the corresponding guiding slots 36.

Therefore, the left and right holding members 34L and 34R are allowed to move relative to the left and right frames 80L and 80R, within the range set by the guiding slots 36.

Figure 12:
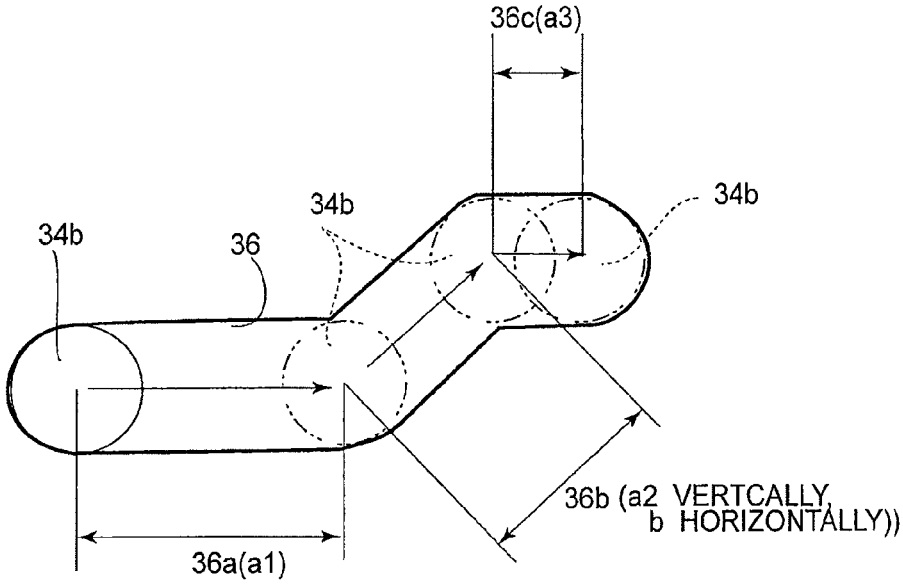
FIG. 12 is an enlarged view of the guiding slot.

FIG. 12 is an enlarged view of one of the guiding slots 36. Each guiding slot 36 is made up of first, second, and third guiding section 36*a*, 36*b*, and 36*c*. The first guiding section 36*a* horizontally extends in the fore-and-aft direction. The second guiding section 36*b* extends frontward from the front end of the first section 36*a*, slanting upward. The third guiding section 36*c* horizontally extends frontward from the front end of the second guiding section 36*b*, being therefore positioned higher than the first guiding section 36*a*. The third guiding section 36*c* constitutes the section which catches and securely holds the pin 34*c*.

As the door 31 is opened, the pins 34*c* (and the holding members 34L and 34R) are moved a distance a1, by the opening movement of the door 31, while being horizontally guided by the first guiding section 36*a* of the guiding slot 36, and then, is moved slantingly upward (horizontally moved by distance a2 while being vertically moved by distance b) while being guided by the second guiding section 36*b*. Then, finally, they are horizontally moved a distance a3 while being guided by the third guiding section 36*c*.

FIG. 11(*a*) shows the state of the mechanical linkage between the door 31 and tray holding members 34L (R), in which the door 31 is completely shut against the apparatus main assembly. When the mechanical linkage is in this state, the left and right holding members 34L and 34R are in their rearmost positions in the apparatus main assembly. The holding members 34L and 34R remain supported by the apparatus main assembly with the presence of the hinge shaft 32, connective arms 37L and 37R, shafts 37*a*, and holes 34*b* between the door 31 and holding members 34L and 34R. Further, each pin 34*c* is located at the rear end of the first guiding section 36*a* of the guiding slot 36. Therefore, the holding members 34L and 34R are in their lowest positions (abovementioned second positions) relative to the left and right frames 80L and 80R, respectively. Therefore, the tray 35, which is remaining held by the holding members 34L and 34R, is also in its lowest position (abovementioned latent image formation position).

Each of the cartridges PY, PM, PC, and PK in the tray 35 is under the pressure applied to its left and right shoulder portions by the abovementioned pressing member. Thus, the bottom side (by which cartridge is accurately positioned) of the peripheral surface of the bearing 51, that is, the bearing on the driven side, and the bottom side (by which cartridge is accurately positioned) of the peripheral surface of the bearing 52, that is, the bearing on the non-driven side, are pressed upon the positioning portions, one for one, with which the stays (internal panels) of the apparatus main assembly A is provided. Thus, each cartridge is accurately positioned and held relative to the apparatus main assembly A. Also, when the mechanical linkage is in the state shown in FIG. 11(*a*), the downwardly facing area of the drum 1 in each cartridge reliably remains in contact with the outward surface of the top side of the belt of the belt unit 12.

The coupler 53 and 54 of each cartridge are coupled with the drum driving coupler and development roller driving coupler, respectively, with which the apparatus main assembly is provided.

To the electrical contacts 55*a*-55*d* of each cartridge, electric power can be supplied from the apparatus main assembly through the corresponding intermediary electrical contacts 72*a*-72*d*.

The tray 35 is provided with a protrusion 67. An intermediary transfer belt holding member 68, which is a stationary member of the apparatus main assembly, is provided with a hole 69. The protrusion 67 of the tray 35 is fitted in the hole 69, whereby the tray 35 is precisely positioned relative to the apparatus main assembly.

FIG. 11(*b*) shows the state of the mechanical linkage between the door 31 and the tray holding members 34L (34R), in which the door 31 is partially open. As the door 31, which is in the closed position as shown in FIG. 11(*a*), is opened, the holding members 34L and 34R are pulled frontward, in the apparatus main assembly, by the movement of the door 31. Therefore, first, the tray holding members 34L and 34R are horizontally moved frontward in the apparatus main assembly, by the distance a1, since the pins 34*c* of the holding members 34L and 34R are horizontally guided by the distance a1 by the first guiding section 36*a*. FIG. 11(*b*) shows the state of the mechanical linkage, in which the holding members 34L and 34R have just finished being horizontally moved frontward by the distance a1. While the left and right holding members 34L and 34R are moved by the distance a1 as described above, the drum driving coupler and development roller driving coupler of each cartridge are disengaged from the counterparts on the apparatus main assembly side, and also, the pressure applied to each cartridge by the pressing member to keep the cartridge precisely positioned is removed. Further, the tip portion of the protrusion 67 remains in the hole 69, with which the stationary member 68 on the apparatus main assembly side is provided, remaining thereby precisely positioned, and therefore, preventing the tray 35 from following the movement of the holding members 34L and 34R.

As the door 31 is opened further, the holding members 34L and 34R are pulled frontward by the rotational movement of the door 31, in the apparatus main assembly. Therefore, the holding members 34L and 34R move in the slanting upward direction, with the pins 34*c* being guided by the second guiding section 36*b* of the guiding hole 36. During this slantingly upward movement of the holding members 34L and 34R, the electrical contacts 55 of each cartridge are electrically disconnected from the counterparts on the apparatus main assembly. That is, the intermediary electrical contacts 72*a*-72*d* become separated from the electrical contacts 75*a*-75*d* on the apparatus main assembly side, respectively, breaking thereby the electrical connection between the cartridge and apparatus main assembly.

Figure 13:
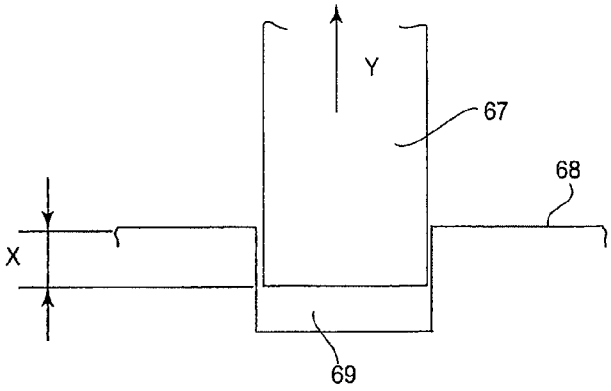
FIG. 13 is an enlarged view of the protrusion (pin) as a tray movement regulating means, and a hole (groove).

Referring to FIG. 13(*a*), a referential character X stands for the distance by which the protrusion 67 enters the hole 69, and a referential character Y stands for the distance by which the holding members 34L and 34R holding the tray 35 are vertically displaced while they are moved frontward in the slantingly upward direction. During this slantingly upward movement of the holding members 34L and 34R, as long as the protrusion of the tray 35 remains in the hole 69 (X>Y), the protrusion 67 follows only the vertical component of the movement of the holding members 34L and 34R. Then, as the holding member 34L (34R) is displaced upward by a certain distance (X<Y), the protrusion 67 comes out of the hole 69. With the provision of the above described structural arrangement, as long as the downwardly facing area of the peripheral surface of the photosensitive drum 1 of each of the cartridges PY, PM, PC, and PK in the tray 35 is in contact with the belt 13, the tray 35 does not horizontally move. Therefore, the drum 1 is prevented from sustaining the scratches which are attributable to the rubbing of the peripheral surface of the photosensitive drum 1 by the belt 13, and/or from developing the memories which also are attributable to the above described rubbing.

FIG. 11(*c*) shows the state of the mechanical linkage, in which the door 31 is completely open. In this state, the holding members 34L and 34R have finished their slantingly upward movement effected by the second guiding section 36*b*, and therefore, the pins 34*c* are in the third guiding section 36*c*, which is horizontal. That is, the holding members 34L and 34R have been horizontally moved after they were moved slantingly upward. The reason for the provision of the above described structural arrangement is to keep the cartridges and holding members 34L and 34R steady in terms of the vertical direction, and also, to prevent the holding members 34L and 34R from shifting rearward when replacing the cartridge(s).

When the mechanical linkage is in the state shown in FIG. 11(*c*), the protrusion 67 has already come out of the hole 69, and therefore, the tray 35 is free from the positional restriction; in other words, the tray 35 can be horizontally moved (slid) relative to the holding members 34L and 34R in the fore-and-aft direction.

The above described protrusion 67 and hole 69 make up the cartridge movement regulating means which prevents the drum 1 in each cartridge, and the belt 13, from moving relative to each other in the direction intersectional to the direction in which the drum 1 comes into contact with the belt 13, when the tray 35, which is a movable member, is in the abovementioned preset position in the apparatus main assembly. The restriction placed upon the tray 35 by this movement regulating means 67 and 69 to prevent the above described deviatory movement of the tray 35 is removed after the tray 35 is moved upward by the vertical component, that is, the component of the movement of the left and right tray holding members 34L and 34R, as the tray moving means, in the direction to separate the drum 1 from the belt 13.

The holding means 34L and 34R as the moving means move (first movement), while being guided by the first guiding section 36*a*, in the direction intersectional to the direction in which the drum 1, which each cartridge has, comes into contact with the belt 13. This first movement is a linear movement. Next, the holding members 34L and 34R move (second movement) in the upwardly slanting direction, that is, the direction having two directional components: the abovementioned separative direction, and the direction intersectional to the separative direction. The second movement is a downward movement. Thereafter, the holding members 34L and 34R move (third movement) in the direction intersectional to the direction in which the drum 1 and belt 13 come into contact with each other. While the holding members 34L and 34R are making the first movement, the driving of the cartridges are ceased. Then, as the tray 35 follows the abovementioned movement of the holding members 34L and 34R in the direction to cause the drum 1 and belt 13 to separate from each other, the tray movement regulating means 67 and 69 are disengaged from each other.

As described above, the cartridges are mounted in the movable member (tray), which is vertically moved by the vertical component of the movement of the tray moving means (tray holding means) to make it easier for the cartridge(s) to be replaced. In other words, the present invention can improve an image forming apparatus in usability. Further, it can make the intermediary electrical contacts 72*a*-72*d* come smoothly in contact with the electrical contacts 75*a*-75*d* on the apparatus main assembly side, respectively. Moreover, it can achieve the aforementioned object of providing an image forming apparatus which has a process cartridge drawer (tray), and yet, does not suffer from the problem that a photosensitive drum is scarred and/or develops memory by being rubbed by, or rubbing against, an intermediary transfer belt.

(Interface Portion Between Cartridge and Apparatus Main Assembly)

Figure 14:
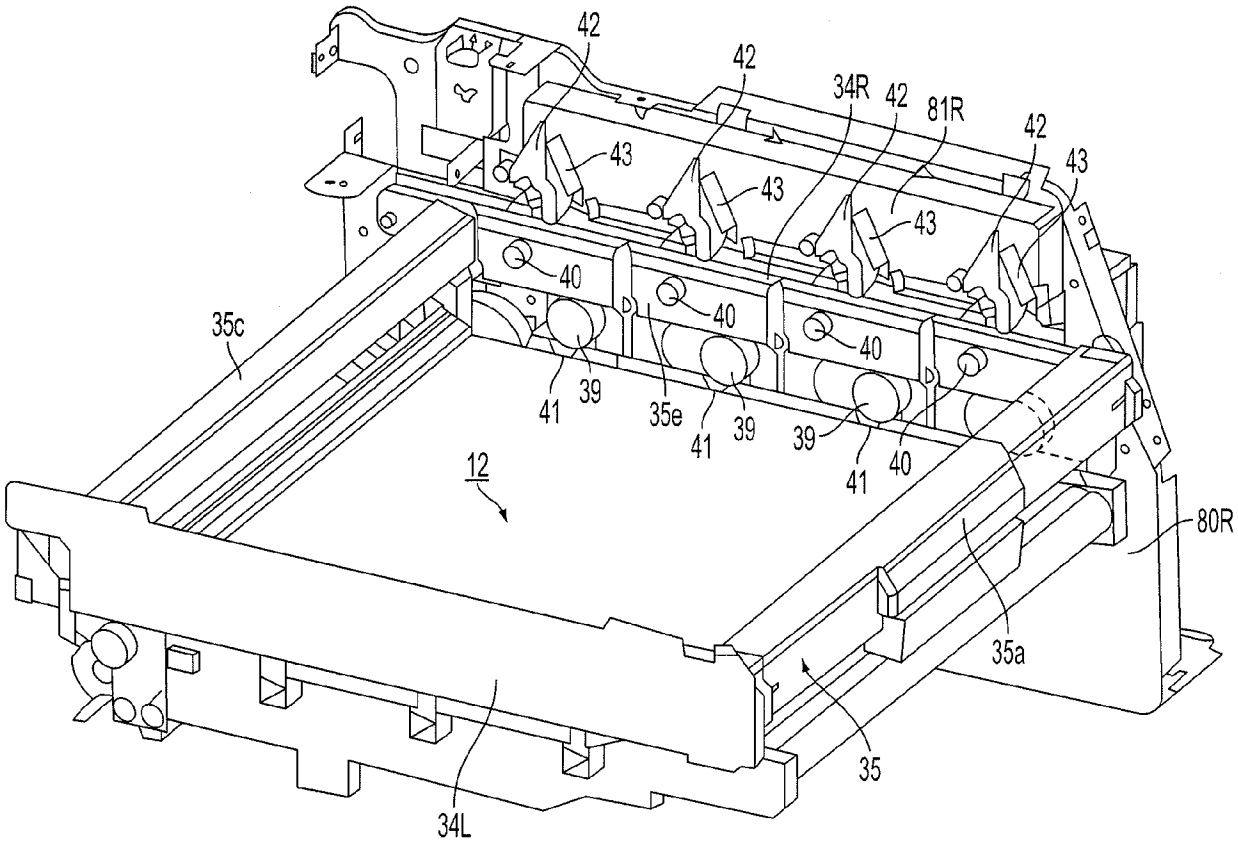
FIG. 14 is a perspective view (1) of the interfacial components and the portions thereof, which are located in the adjacencies of the cartridge bay, and are engaged or disengaged by the movement of the tray holding members.
Figure 15:
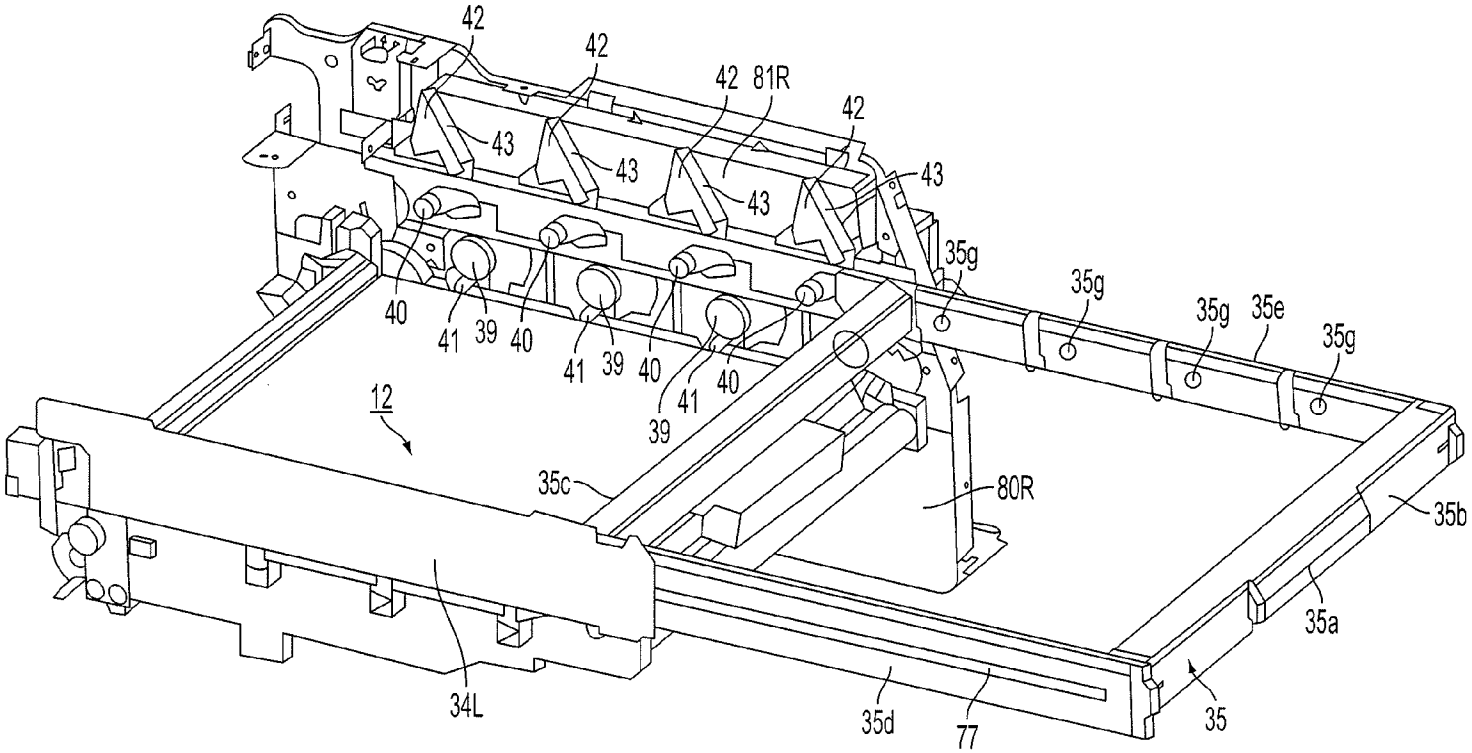
FIG. 15 is a perspective view (2) of the interfacial components and the portions thereof, which are located in the adjacencies of the cartridge bay, and are engaged or disengaged by the movement of the tray holding members.
Figure 16:
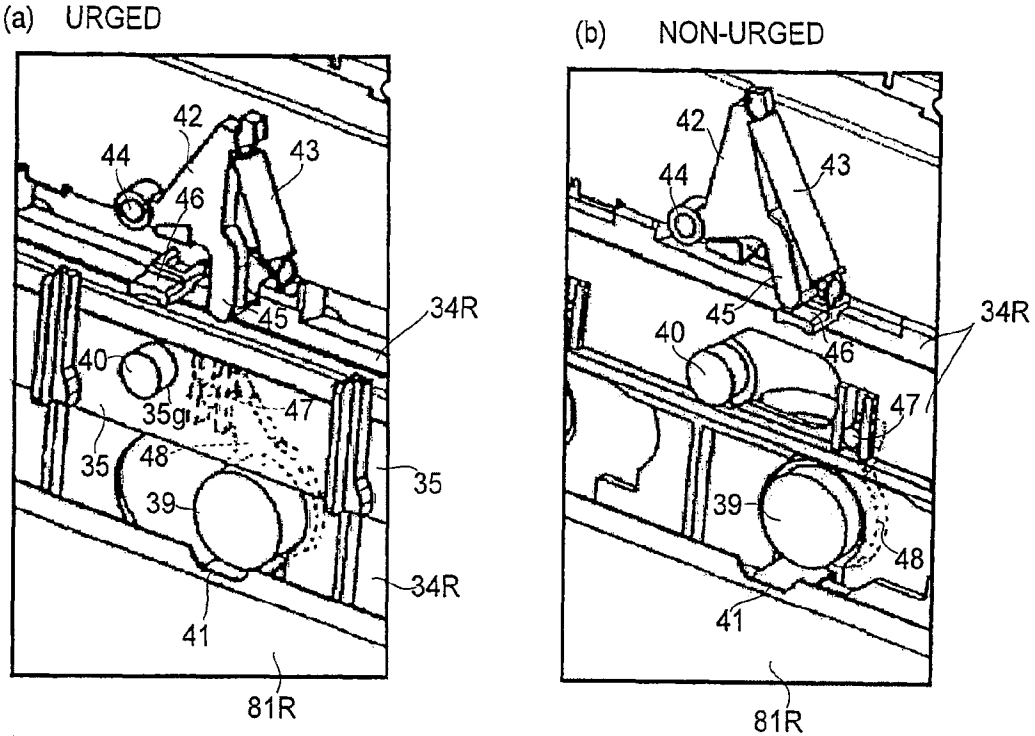
FIG. 16 is a perspective view (3) of the interfacial components and the portions thereof, which are located in the adjacencies of the cartridge bay, and are engaged or disengaged by the movement of the tray holding members.

FIGS. 14-16 are illustrations drawn for describing the interfacial components of each cartridge, which are engaged or disengaged by the movement of the tray holding members 34L and 34R, and their adjacencies.

FIG. 14 is a perspective view of primarily, the holding members 34L and 34R, tray 35, and right frame 80R, which are in the state in which the door 31 is closed as shown in FIGS. 1 and 2, and no cartridge is in the tray 35. FIG. 15 is a perspective view of, primarily, the holding members 34L and 34R, tray 35, and right frame 80R, which are in the state in which the door 31 is open, and the tray 35 has been completely pulled out.

On the right-hand side in the apparatus main assembly A, drum driving force transmission couplers 39 and development roller driving force transmission couplers 40 (which hereafter will be referred to simply as drum coupler and development roller coupler, respectively) are disposed. The drum coupler 39 and development roller coupler 40 constitute the driving force output portions on the apparatus main assembly side, and couple with the driving force input portions 53 and 54 (couplers) (FIG. 7) on the cartridge side. The drum coupler 39 and development roller coupler 40 transmit rotational driving force to the drum 1 and development roller 3*a*, respectively, in each cartridge.

On both the left- and right-hand sides in the apparatus main assembly A, cartridge positioning portions 41 are located, which are parts of the left and right stays 81L and 81R of the apparatus main assembly A (FIG. 24). Each cartridge positioning portion 41 supports the corresponding bearing portions 51 (52), that is, the bearing portion on the driven side (non-driven side), by the downwardly facing portion of the peripheral surface of the cartridge bearing portion 51 (52).

Also on both the left and right sides in the apparatus main assembly, cartridge pressing members 42 are located, which are for keeping the cartridges secured in their preset positions. More specifically, each cartridge pressing member 42 presses on the left and right end portions of the top surface of the corresponding cartridge to keep stable the bearing portion 51 (52), that is, the bearing portion on the driven side (non-driven side), supported by the abovementioned cartridge positioning portion 41. The pressing member 42 is provided with a spring which generates the pressure to be applied by the pressing member 42.

FIG. 16(*a*) is an enlarged view of the pressing member 42, drum coupler 39, development roller coupler 40, and their adjacencies, which are in the state shown in FIG. 14. FIG. 16(*b*) is an enlarged view of the pressing member 42, drum coupler 39, development roller coupler 40, and their adjacencies, which are in the state shown in FIG. 15.

Each pressing member 42 is rotatably attached to the apparatus main assembly A. The pressure generated by the abovementioned spring 43 is applied to the left (right) end portion of the top surface of the corresponding cartridge through the pressing lever portion 45 of the pressing member 42. When the pressing member 42 is in the state shown in FIG. 16(*b*), in which the pressing member 42 is not pressing the cartridge, the pressing level portion 45 of the pressing member 44 has been pushed up by the pressing member raising portion 46 of the holding member 34R, being kept away from the cartridge. That is, the pressure applied to the cartridge has been removed by the movement of the tray holding member 34R.

A release ring 48 (decoupling means for decoupling couplers to prevent driving force from being transmitted to cartridge) is provided with a pin 47. The release ring 48 is fitted around the drum coupler 39 to retract the drum coupler 39. As the holding member 34R is moved, the release ring pin 47 is moved by the movement of the holding member 34R from the position shown in FIG. 16(*a*) to the position shown in FIG. 16(*b*), causing thereby the release ring 48 to move from the position shown in FIG. 16(*a*) to the position shown in FIG. 16(*b*). This movement of the release ring 48 causes the drum coupler 39 and development roller coupler 40 to retract to the positions shown in FIG. 16(*b*). That is, the drum coupler and development roller coupler of each cartridge are disengaged from the counterparts on the apparatus main assembly side.

FIG. 15 shows the states of the drum couplers 39, development roller couplers 40, and pressing members 42, and holding members 34L and 34R, in which the drum couplers 39 and development roller couplers 40 have been disengaged from the counterparts on the apparatus main assembly, by the movement of the holding members 34L and 34R, and the pressing members 42 have been disengaged from the cartridges by the movement of the holding members 34L and 34R. When the abovementioned components are in the states shown in FIG. 15, the tray 35 can be freely slid; the tray 35 can be moved in the direction to be pushed back into the apparatus main assembly, or in the direction to be pulled out of the apparatus main assembly.

As described above, the holding members 34 R and 34L are moved by the opening or closing movement of the door 31. Thus, in order to reduce the amount of force necessary to open or close the door 31, it is desired that the image forming apparatus is structured so that the timing with which the abovementioned pressure is removed from the cartridges is slightly different from the timing with which the couplers are disengaged.

That is, the drum driving force transmission coupler 39, development roller driving force transmission coupler 40, and cartridge pressing member 42 are rendered slightly different in disengagement timing. More specifically, the release ring pin 47 and pressing member raising portion 46 are made different in position to render the drum coupler 39 and pressing member 43 slightly different in disengagement timing, and the four cartridges are rendered slightly different in the drum coupler disengagement timing and pressing member disengagement timing. The employment of this structural arrangement spreads across a preset span of time, the amount of the load which bears on the door 31, reducing thereby the peak load. Therefore, it can reduce the amount of force which a user has to apply to open or close the door 31.

As described above, in this embodiment, not only are the driving force transmitting means (coupler 39 and 40) retracted by the movement of the holding members 34R and 34L, but also, the tray 35 is vertically moved by the movement of the holding members 34R and 34L. That is, the role of disengaging the driving force transmitting means and the role of vertically moving the tray 35 are carried out by the same mechanism, contributing to the reduction of the apparatus main assembly size.

(Tray Position Regulating Means)

Figure 17:
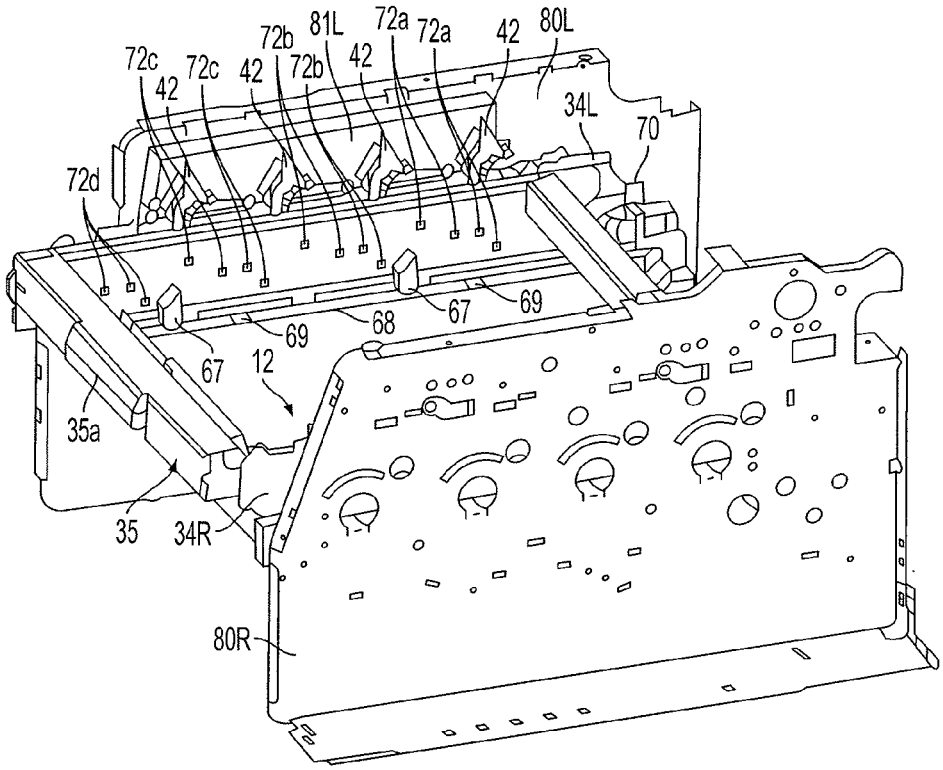
FIG. 17 is a drawing (1) showing the tray position regulating means.
Figure 18:
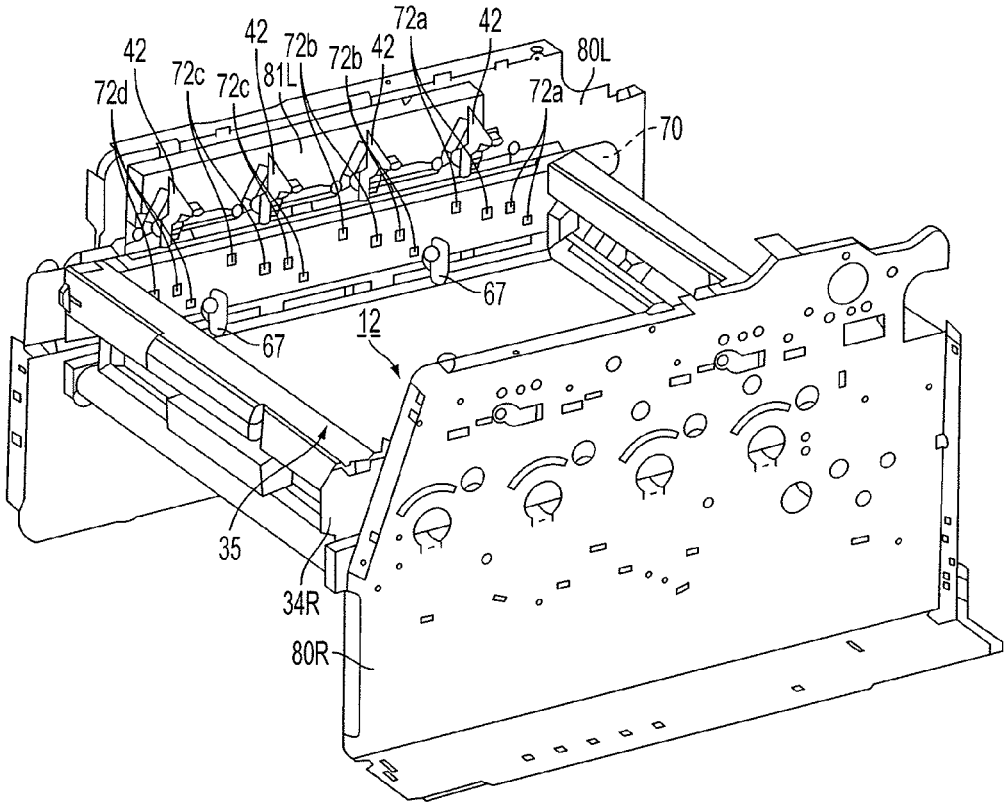
FIG. 18 is a drawing (2) showing the tray position regulating means.
Figure 19:
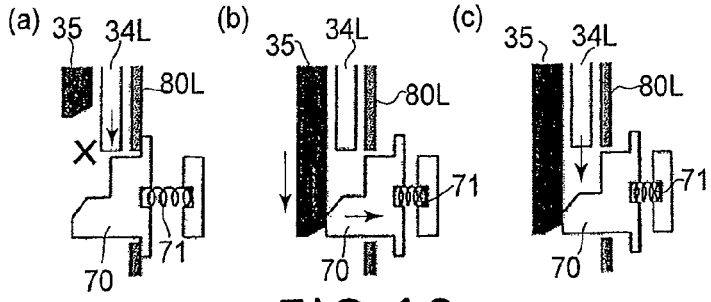
FIGS. 19(*a*) through 19(*c*) are drawings (3) showing the tray position regulating means.

FIG. 17 shows the states of the holding members 34R and 34L, tray 35, and their adjacencies, in which the holding members 34R and 34L and tray 35 are in their topmost positions, into which they were pushed up by the opening movement of the door 31, but the tray 35 have not been completely pushed back into the apparatus main assembly. FIG. 18 shows the states of the holding members 34R and 34L, tray 35, and their adjacencies, in which the tray 35 has been pushed back into the apparatus main assembly as far as possible. FIGS. 19(*a*) through 19(*c*) are schematic drawings showing the movement of the cartridge position regulating means disposed in the left rear portion in the apparatus main assembly.

If the door 31 is closed when the tray 35 is in the state shown in FIG. 17, in which the tray 35 has not been pushed back as far as possible, the rear end of the holding member 34R (34L) strikes a stopper 70 (first regulating member), as shown in FIG. 19(*a*), while the holding member 34R (34L) is moved into the apparatus main assembly by the movement of the door 31. Therefore, the door 31 cannot be closed further to move the holding member 34R (34L) further rearward into the apparatus main assembly in the downwardly slanting direction. However, the tray 35 can be pushed back into the apparatus main assembly. At this point, therefore, the tray 35 is to be push inward of the apparatus main assembly so that the tray 35 will be completely pushed back into the apparatus main assembly as shown in FIG. 18. As the tray 35 is pushed inward of the apparatus main assembly, the rear end of the tray 35 (which constitutes first releasing member which disengages first regulating member) comes into contact with the stopper 70, and moves the stopper 70 from the regulating position to the releasing position against the resiliency of the spring 71, as shown in FIG. 19(*b*). When the tray 35 is in the position shown in FIG. 18 (FIG. 19(*b*)), the stopper 70 does not interfere with the rear end of the holding member 34R (34L) when the holding member 34R is moved rearward by the closing movement of the door 31. In FIG. 19(*b*), the stopper 70 is in the position in which it allows the door 31 to be closed, allowing therefore the holding member 34R to be moved rearward, indicated by an arrow mark in FIG. 19(*c*). Therefore, the door 31 can be closed all the way to rearwardly move the holding members 34R and 34L and tray 35 in the downwardly slanting direction.

That is, while the tray 35 is in a position which is away from the transitional position in the apparatus main assembly, the stopper 70 prevents the door 31 from moving from the open position to the closed position. Further, as the tray 35, which is the first releasing member, is moved into the transitional position in the apparatus main assembly A, it removes the restriction which the stopper 70 places upon the movement of the holding member 34R. That is, the tray 35 removes the restriction which the stopper 70 places, allowing thereby the door 31 to move from the open position to the closed position.

In this embodiment, the cartridges can be easily replaced from the front side of the apparatus main assembly. More specifically, the image forming apparatus is provided with a cartridge tray (drawer), in which the cartridges are placed. When the cartridges are mounted into the apparatus main assembly, they are accurately positioned relative to the apparatus main assembly by the components on the apparatus main assembly side. The drawer (tray) loosely holds the cartridges, and are movable between the outermost position and the transitional position in the apparatus main assembly. Therefore, all that is necessary for a user to do in order to ensure that a cartridge, or cartridges, are precisely positioned in the preset positions in the apparatus main assembly, when the user mount the cartridge(s) or replace the cartridge(s) in the apparatus main assembly is for the user to place the cartridge(s) in the cartridge tray (drawer) from directly above the tray, push the tray 35 into the transitional position, and then, close the door 31. That is, the user does not need to pay attention to the positioning of the cartridges relative to the apparatus main assembly. In other words, this embodiment can provide an image forming apparatus which is simple in the operation which must be carried out by the user to mount a cartridge into the apparatus main assembly, or replace a cartridge in the apparatus main assembly, and yet, ensures that as a cartridge is mounted into the apparatus main assembly, it is precisely positioned relative to the apparatus main assembly.

In this embodiment, however, the image forming apparatus is provided with the member which regulates the movement of the door 31 in coordination of the positioned of the tray 35, and/or the member which regulates the movement of the tray in coordination with the opening or closing movement of the door 31, so that unless the door 31 is fully opened, the tray 35 cannot be moved, or so that unless the tray 35 is completely pushed back into the apparatus main assembly, the door 31 cannot be closed. Therefore, a user is prevented from making operational errors. That is, it does not occur that the tray 35 is operated when the tray 35 is not in its topmost position. Therefore, it does not occur that the drum 1 is rubbed by the belt.

Incidentally, the above described combination of the protrusion 67 and hole 69 (FIGS. 11 and 13) can be utilized as the substitute for the stopper 70 for the tray 35. This setup will be described next, with reference to FIGS. 17, 18, and 19.

When the tray 35 is in the state shown in FIG. 17, in which the tray has not been completely pushed back into the apparatus main assembly, the protrusion 67 of the tray 35 is not in alignment with the hole 69 of the intermediary transfer belt supporting member 68 (stationary member). If an attempt is made to close the door 31 when the tray 35 is in this state, the holding members 34R and 34L are lowered by the closing movement of the door 31, through the connective arms 37R and 37L, and therefore, the tray 35 is lowered. However, the protrusion 67 strikes a regulating portion 66 (edges) provided around the hole 69, preventing thereby the door 31 from being closed.

Figure 20:
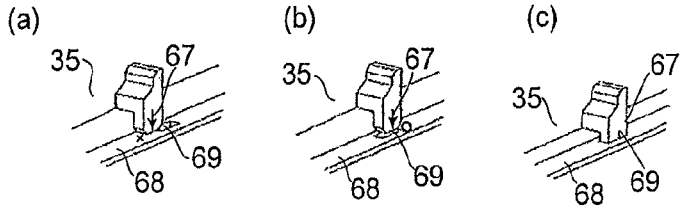
FIGS. 20(*a*) through 20(*c*) are drawings (4) showing the tray position regulating means.

On the other hand, if the tray 35 is lowered when the tray 35 is in the state shown in FIG. 18, in which it has been completely pushed back into the apparatus main assembly, the protrusion 67 enters the hole 69 as shown in FIGS. 20(*b*) and 20(*c*). Therefore, the door 31 can be closed to lower the tray holding members 34R and 34L to lower the tray 35.

Therefore, the tray 35 can be lowered only when the tray 35 is in the transitional position in the apparatus main assembly, in terms of the horizontal direction of the apparatus main assembly A. Therefore, each cartridge is precisely positioned by the cartridge positioning member 41.

Referring to FIGS. 17 and 18, in this embodiment, each of the left and right sections of the primary frame of the tray 35 is provided with two protrusions 67 which are the same in shape, and each of the left and right end portions of the intermediary transfer belt holding member 63 is provided with two hole 69 which are the same in shape. However, the number and shape of the protrusions 67 and holes 69 do not need to be as shown in FIGS. 17, 18, 20(*a*), 20(*b*), and 20(*c*).

Further, when two or more protrusions and holes are provided, they do not need to be the same in shape. Further, the manner in which each protrusion 67 fits into the corresponding hole 69 does not need to be exactly as shown in FIGS. 17, 18, 20(*a*), 20(*b*), and 20(*c*). Moreover, the hole 69 does not need to be a part of the intermediary transfer belt supporting member.

(Structural Arrangement for Supplying Cartridge with Power)

Figure 22:
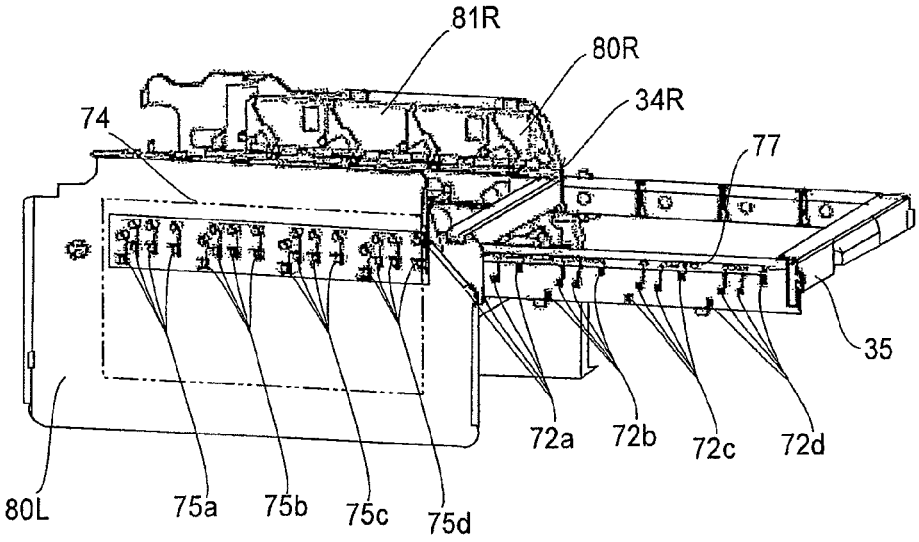
FIG. 22 is a drawing (2) showing the means for supplying electric power to a cartridge.
Figure 23:
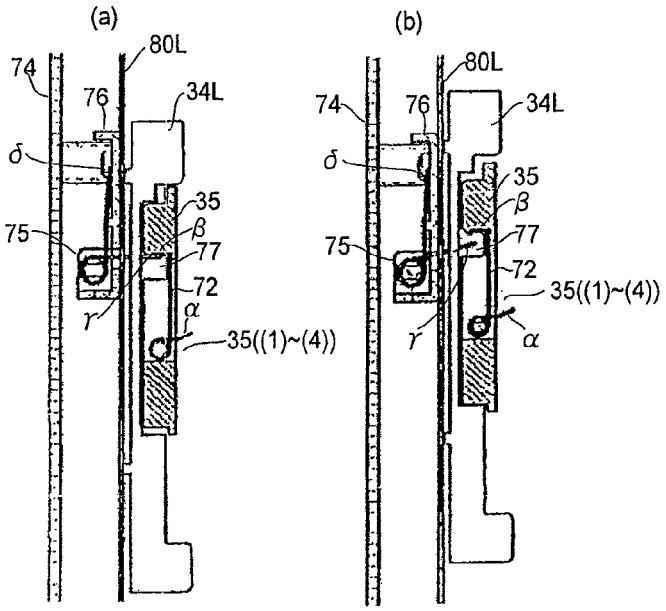
FIGS. 23(*a*) and 23(*b*) are drawings (3) showing the means for supplying electric power to a cartridge

FIGS. 21-23 are drawings for describing the method for supplying electric power to each cartridge from the apparatus main assembly.

FIGS. 21 and 22 show the state of the tray 35, tray holding members 34R and 34L, and their adjacencies, in which the tray 35 has been completely pulled out by opening the door 31. The tray 35 is provided with multiple sets 72*a*-72*d* of intermediary electrical contacts, which are aligned in the direction parallel to the horizontal direction of the apparatus main assembly A. Each intermediary electrical contact 72 is formed of a electrically conductive substance, and is in the form of a spring. One end of each intermediary electrical contact 72 is electrically connected to the corresponding electrical contact (FIG. 8) of the cartridge. Referring to FIGS. 23(*a*) and 23(*b*), each intermediary electrical contact 72 is provided with a first electrical contact point α (FIG. 23 FIGS. 23(*a*) and 23(*b*)), which is on the inward side of the tray 35, and a second electrical contact point β, which is on the outward side of the tray 35. The first electrical contact point α is electrically connectible to the electrical contact point 55 on the cartridge side.

When the cartridge is in the tray 35, being thereby supported by the tray 35, the first electrical contact point α is in contact with the electrical contact point 55 on the cartridge side, and therefore, there is electrical connection between the cartridge and tray 35. The first electrical contact point α is elastic, and protrudes slight into the corresponding cartridge compartment (35(1)-35(4)) of the tray 35. Therefore, while the cartridge settles into one of the abovementioned cartridge compartments 35(1)-35(4) after it is released by a user, the first electrical contact point α elastically deforms as it comes into contact with the electrical contact 55 on the cartridge side. Therefore, the first electrical contact point α smoothly connects with the electrical contact 55 on the cartridge side.

The apparatus main assembly is provided with multiple sets 75*a*-75*d* of electrical contacts, which are on the inward side of the apparatus main assembly, being aligned along the path of the tray 35. More specifically, each electrical contact 75 is formed of an electrically conductive elastic substance, and is in the form of a spring. It is electrically connected to the electrical power supply portion 74 on the apparatus main assembly side, which is located outside the left frame 80L, that is, the left section of the main frame of the apparatus main assembly. The multiple sets 75*a*-75*d* of the electrical contacts are aligned in the horizontal direction of the apparatus main assembly. Each electrical contact 75 protrudes toward the tray 35 through the hole with which the left frame 80L is provided, and the hole with which the left holding member 47L is provided. The abovementioned second electrical contact point β of the intermediary electrical contact 72 is electrically connectible to this electrical contact 75 on the apparatus main assembly side.

FIGS. 23(*a*) and 23(*b*) show how the intermediary electrical contact 72, with which the tray 35 is provided, is electrically connected to, or disconnected from, the electrical contact 75 on the apparatus main assembly side. FIGS. 23(*a*) and 23(*b*) show the same portions of a sectional view of the tray 35, intermediary electrical contact 72, left tray holding member 34L, left frame 80L, electrical contact 75 on the apparatus main assembly side, electrical contact holder 76 on the apparatus main assembly side, and power supply portion 74 on the apparatus main assembly side, as seen from the front side of the apparatus main assembly.

FIG. 23(*a*) shows the state of the abovementioned components, in which the door 31 is in the closed position, and the left tray holding member 34L and tray 35 are in their preset positions, into which they have been lowered, in the apparatus main assembly. When they are in this state, the electrical contact 75 on the apparatus main assembly side is electrically in contact with the intermediary electrical contact 72.

FIG. 23(*b*) shows the state of the abovementioned components, in which the door 31 is in the open position, and the left tray holding member 34L and tray 35 are at their top levels to which they have been raised from the preset positions in the apparatus main assembly. When they are in this state, there is no electrical contact between the electrical contact 75 on the apparatus main assembly side and the second electrical contact point β of the intermediary electrical contact spring 72. In order to prevent the tray 35 from contacting the portion γ of the electrical contact 75 on the apparatus main assembly, which protrudes toward the tray 35 beyond the holding member 34L, the tray 35 is provided with a space (groove) 77 which extends in the fore-and-aft direction of the apparatus main assembly. Therefore, the tray 35 can be pulled out without coming in contact with the electrical contact 75 of the apparatus main assembly.

The second electrical contact point β of the intermediary electrical contact 72 is above the space 77.

The abovementioned space 77 is located between the tray 35 and the electrical contact 75 on the main assembly side, preventing thereby the tray 35 from coming into contact with the electrical contact 7 on the apparatus main assembly side while the tray 35 is moved from inside the apparatus main assembly to the outside of the apparatus main assembly. The second electrical contact point β of the intermediary electrical contact 72 becomes electrically connected with the end portion (extending portion) γ of the electrical contact 75 on the apparatus main assembly side, which inwardly protrudes toward the tray 35, while the tray 35 is moved downward after it is horizontally moved into the apparatus main assembly from outside the apparatus main assembly.

The top end of the main assembly electrical contact 75 constitutes a fixation point δ. The abovementioned horizontal movement of the tray 35 into the apparatus main assembly from outside the apparatus main assembly causes the extending portion γ of the electrical contact 75 to enter the space 77 (groove) of the tray 35. Then, while the tray 35 is moved downward, the extending portion γ comes into contact with the second electrical contact points β of the intermediary electrical contact 72, being thereby elastically deformed.

More specifically, the apparatus main assembly is provided with electrical contacts 75*a*-75*d*, which are disposed so that their positions do not coincide with the path of the intermediary electrical contacts 72*a*-72*d*. The apparatus main assembly is structured so that the electrical connection between the intermediary electrical contacts and corresponding electrical contacts of the apparatus main assembly can be broken by moving upward (raising) the tray 35 from the preset position by the holding members 34L and 34R, or can be established by moving downward (lowering) the tray 35 toward its preset position by the holding members 34 L and 34R.

In this embodiment, the apparatus main assembly has: an electrical contact c for supplying the charge roller 2 with the charge bias for charging the drum 1; an electrical contact a for supplying the development roller 3*a* with the development bias for developing the electrostatic latent image formed on the drum 1; an electrical contact d for supplying the developer supply member (unshown) with the supply bias; and an electrical contact b for supplying the develop regulating member (unshown). The cartridge has: the electrical contact c which contacts the charge bias contact c of the apparatus main assembly; an electrical contact a which contacts the development bias contact a of the apparatus main assembly; an electrical contact d which contacts the supply bias contact d of the apparatus main assembly; and an electrical contact b which contacts the electrical contact b of the apparatus main assembly.

Further, when the multiple cartridges are the same in the bias to be applied thereto, the tray 35 may be provided with an electrically conductive member, which functions as an intermediary electrical contact, and can be connected to, or disconnected from, the single electrical contact of the apparatus main assembly. To this electrically conductive member of the tray 35, one end of each of the multiple electrical contact springs is electrically connected, and the other end is rendered electrically connectible to, or disconnectible from, the corresponding electrical contact of the cartridge, which is connected to one of the cartridge sections which need to be supplied with electric power. This structural arrangement makes it possible to reduce the number of the electrical junctions between the intermediary electrical contact spring and electrical contact springs of the apparatus main assembly. Incidentally, the shape of the electrical contact spring of the apparatus main assembly, shape of the intermediary electrical contact spring, and the direction of the contact pressure in each electrical junction, do not need to be as shown in FIGS. 21-23.

That is, an image forming apparatus may be structured so that the electrically conductive member is disposed in the tray 35, and the number of the electrical junctions between the intermediary electrical contacts and the electrical contacts of each cartridge is greater than the number of the electrical junctions between the intermediary electrical contacts and the electrical contacts of the apparatus main assembly. The employment of such a structural arrangement can make it possible to reduce the component count of an image forming apparatus, making it therefore possible to reduce the cost of the image forming apparatus, provided that the image forming apparatus is designed so that the multiple cartridges, which are different in the color of the toner they use, are the same in voltage requirement.

As described above, the cartridges are placed in the movable member (tray) so that they can be easily accessed from the front side of the apparatus main assembly to replace them, and the movable member is provided with an intermediary electrical contacts which are connected to, or separated from, the electrical contacts of the apparatus main assembly, by the upward or downward displacement of the movable member. Therefore, it is possible to provide an image forming apparatus which employs a process cartridge drawer (tray) system which makes it easier to replace the process cartridges, and yet, is no higher in cost and size than an image forming apparatus in accordance with the prior art.

Further, the movable member is displaced upward or downward by the movement of the member which exposes or covers the opening of the apparatus main assembly through which a cartridge is mounted or removed. Therefore, the method for replacing any of the cartridges in the apparatus main assembly is virtually self explanatory to a user.

Further, multiple electrical contacts are horizontally aligned; they are rendered the same in vertical position. Therefore, in terms of the vertical direction of the apparatus main assembly, they do not take up as much internal space of the apparatus main assembly as those of an image forming apparatus in accordance with the prior art. Therefore, this embodiment can reduce the size of the main assembly of an image forming apparatus.

The tray 35 is movable in the direction intersectional to the lengthwise direction of the electrophotographic photosensitive member of each process cartridge, while holding multiple process cartridges; it is movable between its preset most inward and most outward positions relative to the apparatus main assembly.

The electrical contact 75 as the electrical contact on the main assembly side is disposed along the path of the tray 35, in the apparatus main assembly A.

The intermediary electrical contact is provided with the first electrical contact point A and second electrical contact point B. It is the tray 35 that is provided with the first and second electrical contact points α and β. The first electrical contact point α is on the inward side of the tray 35, whereas the second electrical contact point β is on the outward side of the tray 35. The first electrical contact point α contacts the electrical contact 55, that is, the electrical contact on the cartridge side β, and second electrical contact point contacts the electrical contact 75, that is, the electrical contact on the main assembly side.

In order to prevent the tray 35 from contacting the electrical contact 75 with which the apparatus main assembly A is provided, when the tray 35 is moved from its outward position, relative to the apparatus main assembly, into its inward position, the space 77 is provided between the tray 35, and the electrical contact 75 on the apparatus main assembly side. In this embodiment, the lateral section 35*d* of the frame of tray 35 is provided with the space 77 which extends in the direction parallel to the moving direction of the tray 35. The space 77 is a recess which is on the outward side of the tray 35, and opposes the electrical contact 75 on the apparatus main assembly side; the top side of this recess faces the electrical contact 75. In this embodiment, the space 77 is a space located below the path of the tray 35.

When the tray 35 is moved into the apparatus main assembly A, first, it is horizontally moved, and then, it is moved slantingly downward. It is during this slantingly downward movement of the tray 35 that the second electrical contact point β comes into contact with the electrical contact 75 on the apparatus main assembly side.

As described above, according to this embodiment, even in the case of an image forming apparatus employing the tray 35 which is linearly movable relative to the apparatus main assembly A and is capable of supporting multiple process cartridges side by side, it is ensured that electrical connection is established between the electrical contact 55 (electrical contact on cartridge side) and electrical contact 75 (electrical contact on main assembly side).

Incidentally, when the tray 35 is moved outward of the apparatus main assembly A, the above described sequence which occurred as the tray 35 was moved into the apparatus main assembly occurs in reverse. Therefore, the second electrical contact point β is separated from the electrical contact 75.

Also according to this embodiment described above, as the tray 35 is moved into the apparatus main assembly from its outward position, the end portion γ (extending portion) of the electrical contact 75 (electrical contact on main assembly side (a, b, and c)) enters the space 77 (recess). Then, while the tray 35 is moved slantingly downward after being horizontally moved, the end portion γ contacts, while elastically deforming, the second electrical contact point β (a, b, and c), which is located in the top portion of the space 77 (recess) (FIGS. 23(*a*) and 23(*b*)).

Further, the end portion (extending portion) γ of the electrical contact 75(*d*) is in the space 77 which is below the path of the tray 35. The end portion γ contacts, while elastically deforming, the second electrical contact point β(d) attached to the top surface (adjacencies of bottom surface of tray 35) of the space 77, while the tray 35 is moved slantingly downward after being horizontally moved (unshown).

Therefore, as the tray 35 is slantingly moved downward, the electrical contact 55 (contact on process cartridge side) is smoothly connected with the electrical contact 75 (electrical contact on apparatus main assembly side); electrical contacts (a, b, c, and d) on the cartridge side are smoothly connected with the electrical contacts (a, b, c, and d) on the apparatus assembly side.

In this embodiment described above, the tray 35 was horizontally moved relative to the apparatus main assembly A; it is moved in the direction parallel to the surface on which the apparatus main assembly A is placed. Further, the tray 35 is linearly moved relative to the apparatus main assembly A. However, this embodiment is not intended to limit the direction in which the movable member is moved. For example, the image forming apparatus may be structured so that the movable member is linearly moved in the slantingly upward or downward relative to the surface on which the apparatus main assembly A is placed. Obviously, even in such a case, the image forming apparatus must be structured so that after the movable member is linearly moved, it is moved slantingly downward relative to the direction in which it is linearly moved.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 340005/2006, and 004022/2006 filed Dec. 18, 2006 and Jan. 11, 2006, respectively which are hereby incorporated by reference.

What is claimed is:

1. An electrophotographic image forming apparatus for forming an image on a recording material, said electrophotographic image forming apparatus comprising:

a main assembly frame;

a belt member provided inside of said main assembly frame;

a movable member, movably supported by said main assembly frame, for supporting and moving a cartridge, said movable member being movable between (i) a first position in which an electrophotographic photosensitive member carried on said movable member is contacted to said belt member, and a latent image can be formed on said electrophotographic photosensitive member, and (ii) a second position in which said electrophotographic photosensitive member is spaced from said belt member inside said main assembly frame, and said movable member being movable between the second position and (iii) a third position in which said cartridge is mountable and demountable relative to said movable member outside of said main assembly frame; and a main assembly side electrical contact provided in said main assembly frame, wherein said main assembly side electrical contact is electrically connected with an electrical contact provided on said cartridge carried on said movable member when said movable member is positioned at the first position, wherein said main assembly frame is provided with a door for opening and closing an opening through which said movable member passes, and wherein said movable member is moved from the second position to the first position in interrelation with a closing operation of said door, and said movable member is moved from the first position to the second position in interrelation with an opening operation of said door.

2. An apparatus according to claim 1, wherein said movable member moves between the second position and the third position in a crossing direction crossing a longitudinal direction of said electrophotographic photosensitive member.

3. An apparatus according to claim 2, wherein said movable member moves from the second position to the first position in a direction crossing said longitudinal direction and said crossing direction.

4. An apparatus according to claim 1, wherein said main assembly side electrical contact is provided on a movement path that said movable member moves between the second position and the third position inside said main assembly frame.

5. An apparatus according to claim 1, wherein said belt member is a transfer belt for receiving a toner image from said electrophotographic photosensitive member.

6. An apparatus according to claim 1, wherein in a state that said door is open, said belt member is inside said main assembly frame.

7. An apparatus according to claim 6, wherein said belt member is disposed upstream of said movable member with respect to a direction in which said movable member moves from the first position to the second position.

8. An apparatus according to claim 1, wherein said electrophotographic photosensitive member is spaced from said belt member when said movable member is positioned at the second position.

9. An apparatus according to claim 1, wherein said main assembly side electrical contact is electrically connected with said cartridge side contact by an intermediary electrical contact provided on said movable member when said movable member is positioned at said first position.

10. An apparatus according to claim 1, wherein said movable member is slidable relative to said main assembly frame between the second position and the third position.

11. An electrophotographic image forming apparatus for forming an image on the recording material, said electrophotographic image forming apparatus comprising:

a main assembly frame;

a belt member provided inside of said main assembly frame;

a movable member, movably supported by said main assembly frame, for supporting and moving a plurality of cartridges, said movable member being movable between (i) a first position in which electrophotographic photosensitive members carried on said movable member are contacted to said belt member, and latent images can be formed on said electrophotographic photosensitive members, and (ii) a second position that is inside of said main assembly frame and in which said movable member is retracted from said first position in a direction away from said belt member; and a plurality of main assembly side electrical contacts provided in said main assembly frame, wherein said main assembly side electrical contacts are electrically connected with cartridge side electrical contacts provided on associated cartridges carried on said movable member when said movable member is positioned at the first position, wherein said main assembly frame is provided with a door for opening and closing an opening through which said movable member passes, and wherein said movable member is moved from the second position to the first position in interrelation with a closing operation of said door, and said movable member is moved from the first position to the second position in interrelation with an opening operation of said door.

12. An apparatus according to claim 11, wherein said movable member is movable to a third position in which said cartridges are mountable and demountable relative to said movable member outside of said main assembly frame.

13. An apparatus according to claim 12, wherein said movable member moves between the second position and the third position in a crossing direction crossing longitudinal directions of said electrophotographic photosensitive members.

14. An apparatus according to claim 13, wherein said movable member moves from the second position to the first position in a direction crossing said longitudinal direction and said crossing direction.

15. An apparatus according to claim 12, wherein said main assembly side electrical contacts are provided on a movement path which said movable member moves between the second position and the third position inside said main assembly frame.

16. An apparatus according to claim 12, wherein said main assembly side electrical contacts each include (i) a main assembly side charging bias contact element for supplying a charging bias voltage to a charging roller for charging one of said electrophotographic photosensitive members, and (ii) a main assembly side developing bias contact element for supplying a developing bias voltage to a developing roller for developing an electrostatic latent image formed on one of said electrophotographic photosensitive members.

17. An apparatus according to claim 11, wherein said cartridges include a cartridge accommodating a black developer, a cartridge accommodating a cyan developer, a cartridge accommodating a magenta developer, and a cartridge accommodating yellow developer.

18. An apparatus according to claim 11, wherein said belt member is a transfer belt for receiving a toner image from said electrophotographic photosensitive members.

19. An apparatus according to claim 11, wherein in a state that said door is open, said belt member is inside said main assembly frame.

20. An apparatus according to claim 19, wherein said belt member is disposed upstream of said movable member with respect to a direction in which said movable member moves from the first position to the second position.

21. An apparatus according to claim 11, wherein said electrophotographic photosensitive members are spaced from said belt member when said movable member is positioned at the second position.

22. An apparatus according to claim 11, wherein said main assembly side electrical contacts are electrically connected with said cartridge side contacts by intermediary electrical contacts provided on said movable member when said movable member is positioned at the first position.

23. An apparatus according to claim 11, wherein said movable member is slidable relative to said main assembly frame between the second position and the third position.

* * * * *